US009112321B2

(12) United States Patent
Bhosale et al.

(10) Patent No.: US 9,112,321 B2
(45) Date of Patent: Aug. 18, 2015

(54) ILLUMINATED RECEPTACLE

(75) Inventors: Vikramsinh Bhosale, West Babylon, NY (US); Mario Angelides, Oceanside, NY (US); Joseph DeConinck, West Babylon, NY (US); Michael Mattei, Saint James, NY (US)

(73) Assignee: LEVITON MANUFACTURING COMPANY, INC., Melville, NY (US)

( * ) Notice: Subject to any disclaimer, the term of this patent is extended or adjusted under 35 U.S.C. 154(b) by 941 days.

(21) Appl. No.: 12/981,745

(22) Filed: Dec. 30, 2010
(Under 37 CFR 1.47)

(65) Prior Publication Data

US 2012/0170292 A1 Jul. 5, 2012

(51) Int. Cl.

| | |
|---|---|
| ***H01R 25/00*** | (2006.01) |
| ***H01R 13/66*** | (2006.01) |
| ***H01R 13/717*** | (2006.01) |
| *H01R 24/78* | (2011.01) |
| *H01R 103/00* | (2006.01) |

(52) U.S. Cl.
CPC ..... *H01R 25/006* (2013.01); *H01R 13/6658* (2013.01); *H01R 13/717* (2013.01); *H01R 24/78* (2013.01); *H01R 2103/00* (2013.01)

(58) Field of Classification Search
CPC ..... H01R 25/006; H01R 13/6658; H01R 13/717; H01R 24/78; H01R 2103/00
USPC ..... 362/23.01, 555, 311.02, 147, 249.01, 362/249.02; 174/66; 439/133, 226, 490
See application file for complete search history.

(56) References Cited

U.S. PATENT DOCUMENTS

| | | | | |
|---|---|---|---|---|
| 2,612,597 | A * | 9/1952 | Sherrard | 362/560 |
| 3,265,888 | A * | 8/1966 | Adolphson, Jr. | 362/95 |
| 3,435,169 | A | 3/1969 | Bienwald et al. | |
| 3,588,489 | A | 6/1971 | Gaines | |
| 3,895,225 | A | 7/1975 | Prior | |
| 4,000,405 | A * | 12/1976 | Horwinski | 362/95 |
| 5,146,385 | A | 9/1992 | Misencik | |
| 5,277,620 | A | 1/1994 | Taylor | |
| 5,396,062 | A | 3/1995 | Eisentraut et al. | |
| 5,413,501 | A | 5/1995 | Munn | |
| 5,934,451 | A | 8/1999 | Yu et al. | |
| 6,078,113 | A | 6/2000 | True et al. | |
| 6,089,893 | A | 7/2000 | Yu et al. | |
| 6,547,411 | B1 | 4/2003 | Dornbusch | |

(Continued)

OTHER PUBLICATIONS

Co-pending U.S. Appl. No. 12/725,991, filed Dec. 30, 2010.

(Continued)

*Primary Examiner* — Mary McManmon
(74) *Attorney, Agent, or Firm* — Kacvinsky Daisak Bluni PLLC

(57) ABSTRACT

The present invention relates to an illuminated receptacle. In one particularly preferred embodiment, the receptacle preferably includes a body, a cover for coupling to said body, said cover having one or more sockets for receiving a plug, a tamper resistant (TR) platform associated with each of the one or more sockets, each of the TR platforms being disposed between the body and the cover, each of the TR platforms including a cavity and an aperture extending thru said platform in said cavity, a slider disposed within each of the cavities of the platform and aligned with the openings of a respective socket, and a light source disposed within each of the apertures formed in the platforms, the light sources operatively coupled to electrical power for generating light to illuminate said slider, the light sources being positioned to directly transmit light to the sliders.

28 Claims, 16 Drawing Sheets

(56) References Cited

U.S. PATENT DOCUMENTS

| | | | | |
|---|---|---|---|---|
| 6,827,602 | B2 | 12/2004 | Greene et al. | |
| 7,036,948 | B1 | 5/2006 | Wyatt | |
| 7,045,975 | B2 | 5/2006 | Evans | |
| 7,161,313 | B2 | 1/2007 | Piepgras et al. | |
| 7,355,117 | B2 * | 4/2008 | Castaldo et al. | 174/53 |
| 7,357,652 | B1 | 4/2008 | Arenas et al. | |
| 7,554,033 | B1 | 6/2009 | Bhosale et al. | |
| 7,596,950 | B2 | 10/2009 | Woltmann et al. | |
| D603,983 | S | 11/2009 | Richter et al. | |
| D603,984 | S | 11/2009 | Richter et al. | |
| D603,985 | S | 11/2009 | Richter et al. | |
| D604,873 | S | 11/2009 | Richter et al. | |
| 7,635,273 | B2 * | 12/2009 | Buzil et al. | 439/214 |
| 7,666,010 | B2 | 2/2010 | Arenas et al. | |
| 7,690,942 | B2 | 4/2010 | Berg et al. | |
| 7,712,949 | B2 | 5/2010 | Tufano et al. | |
| 7,726,825 | B2 * | 6/2010 | Mandapat et al. | 362/95 |
| 7,736,174 | B2 | 6/2010 | Bhosale et al. | |
| 7,820,909 | B2 | 10/2010 | Castaldo et al. | |
| 8,044,299 | B2 * | 10/2011 | Weeks | 174/53 |
| 2002/0112945 | A1 * | 8/2002 | Lawson et al. | 200/50.28 |
| 2003/0092297 | A1 * | 5/2003 | Reindle et al. | 439/107 |
| 2007/0193866 | A1 | 8/2007 | Eder et al. | |
| 2007/0211397 | A1 * | 9/2007 | Sokolow et al. | 361/42 |
| 2008/0073117 | A1 | 3/2008 | Misener | |
| 2008/0224835 | A1 * | 9/2008 | Noest | 340/286.11 |
| 2008/0233780 | A1 | 9/2008 | Waters et al. | |
| 2009/0032278 | A1 | 2/2009 | Weeks et al. | |
| 2009/0052162 | A1 | 2/2009 | Richter et al. | |
| 2009/0103329 | A1 | 4/2009 | Wu et al. | |
| 2009/0109653 | A1 | 4/2009 | Wu et al. | |
| 2009/0149062 | A1 * | 6/2009 | Valentin et al. | 439/538 |
| 2009/0213567 | A1 | 8/2009 | Mandapat et al. | |
| 2010/0120274 | A1 | 5/2010 | Arenas et al. | |
| 2010/0227484 | A1 | 9/2010 | Arenas et al. | |
| 2011/0104919 | A1 * | 5/2011 | Patel et al. | 439/137 |
| 2012/0115372 | A1 * | 5/2012 | Bazayev et al. | 439/733.1 |

OTHER PUBLICATIONS

Leviton Specifier Catalog Z-76, 1977, by Leviton Manufacturing Company, Inc., (May 1977).

Leviton Wiring Device Catalog D-400, 1997, by Leviton Manufacturing Company, Inc.

* cited by examiner

ILLUMINATED RECEPTACLE

The present invention relates generally to electrical receptacles, and more particularly, to an illuminated tamper proof or tamper resistant (TR) electrical receptacle.

BACKGROUND

FIG. 1 shows as existing receptacle device 10, e.g., an electrical power outlet used in emergency circuits such as located in hospitals and pediatric areas. As depicted in FIG. 1 and described in greater detail in commonly-owned U.S. Pat. No. 6,827,602 the whole contents and disclosure of which is incorporated by reference herein, the receptacle includes a cover 30 having one or more sockets 32, a body 80 to which the cover 30 is secured to provide a housing for internal conductive terminals 47 including respective terminal structures 47*a*, 47*b* corresponding to respective Hot (phase) or Neutral of an alternating current power source (e.g., 120 Vac, 15 amps source) and each situated in respective alignment with respective blade or prong openings 37*a*, 37*b* formed in sockets 32 of the cover 30 for receiving corresponding blades or prongs, including polarized blades, of an electrical plug or adaptor (not shown). Receptacle 10 includes a strap subassembly 90 providing internal electrical ground terminals 47*c* with the body 80 in alignment with respect blade or prong openings 37*c* formed in each respective socket 32 for receiving a corresponding ground blade or prong of the adaptor or device. The strap 90 includes structures, e.g., slots, pins, etc., that permit the receptacle 10 to be mounted to threaded mounting holes of a standard outlet box (not shown). Strap 90 may be affixed to the body 80 by a center pin shaft and pin or mounting screw (not shown) that additionally affixes the cover 30 to the body 80. A bushing 95 for a mounting screw is provided for securing the body 80 to the cover 30.

As shown in the exploded view of FIG. 1, the cover 30 of the existing receptacle 10 includes an indicator 45 which identifies the receptacle as being a hospital grade receptacle. In one prior implementation, the indicator 45 is a colored window formed in the face of the receptacle that is always visible. A light emitting source (not shown) such as a light emitting diode is located behind the window and coupled across the phase and neutral contacts of the receptacle to provide a positive indication (illumination) that the receptacle 10 is connected to a live circuit.

In use, the indicator 45 is designed to illuminate the colored window, e.g., a green colored "dot", on the cover 30. The existing indicator 45 does not illuminate the socket blade or prong openings.

The receptacle shown in FIG. 1 may be further configured according to teachings of which may be found in commonly-owned U.S. Pat. Nos. 7,357,652, 7,666,010 and commonly-owned, co-pending U.S. Patent Published Application Nos. 2010/0120274 and 2010/0227484 that each describe an existing receptacle technology known as Lev-Lok® (registered trademark of LEVITON MANUFACTURING CO., INC., Melville, N.Y.).

Further, it is known in the art, to incorporate a TR mechanism to prevent improper use of the power socket. An example of a TR mechanism is disclosed in commonly-owned U.S. Pat. No. 7,820,909.

A TR receptacle that illuminates the TR portion of the electrical power outlet would be highly desirable.

More generally it is desirable to provide a method and apparatus for illuminating select portions of an electrical receptacle, including wall-mounted or ceiling-mounted electrical devices, e.g., TR or non-TR electrical receptacle.

SUMMARY

In one aspect there is provided a method and apparatus for illuminating receptacles for wall-mounted or ceiling-mounted electrical devices such as a tamper proof or tamper resistant (TR) electrical power outlet.

Generally, the apparatus for illuminating receptacles is configured to illuminate blade openings/visible area, e.g., that would assist a user to locate the TR plug openings along with identifying power.

More particularly, there is provided a platform assembly for illuminating a TR receptacle, e.g., an electrical power outlet receptacle, that is adapted to diffusely transmit light to a receptacle opening from an illuminator. In this aspect, the platform assembly for illuminating a TR receptacle, e.g., electrical power outlet receptacle, is adapted to diffusely transmit light to a translucent or partially translucent movable TR member which can be observed through the socket blade openings.

In this embodiment, a receptacle face and/or blade openings of a power outlet that includes a TR mechanism (e.g., in a TR receptacle) are illuminated by LEDs which are situated within a TR platform supporting the movable TR member for directly illuminating the movable TR member.

In one embodiment, there is provided: a method and apparatus for illuminating receptacles, the apparatus comprising: a housing configured to be received within an electrical box, the housing including electrically conductive terminals for receiving electrical power and one or more sockets for receiving a plug to receive electrical power from the electrical box, each socket having at least two openings aligned with the electrically conductive terminals for receiving a respective prong of the plug; a TR platform associated with each of the one or more sockets, each of the TR platforms being disposed between the housing, each of the TR platforms including a cavity and an aperture extending thru the platform in the cavity; a slider disposed within each of the cavities of the platform and aligned with the at least two openings of a respective socket, the slider adapted to one of: prevent or permit insertion of the prongs within the at least two openings of a respective the one or more sockets; and, a light source disposed within each of the apertures formed in the platforms, the light sources operatively coupled to the electrical power for generating light to illuminate the slider, the light sources being positioned to directly transmit light to the sliders.

In this aspect, the housing includes a body and a cover for coupling to the body, the body including the electrically conductive terminals for receiving electrical power, the cover including the one or more sockets for receiving a plug to receive electrical power from the electrical box.

In a further aspect, the housing includes a first socket structure and a second socket structure, the TR platform defining first and second cavities adapted to fit within the respective first socket and second socket structures, the first and second TR platforms connected by an intermediate connector member, wherein the first and second TR platforms and intermediate connector member are of unitary construction.

Further to this, the apertures formed in the platform and the light source disposed within each aperture are configured such that emitted light is concentrated in a form of a cone to directly illuminate the slider.

In a further aspect, the illuminating receptacle for the TR structure is a hospital grade power outlet receptacle.

In a further aspect, there is provided an apparatus for illuminating both a TR receptacle and non-TR receptacle that provides an illuminator device adapted to illuminate a lens/visible surface using an electronic circuit. In this embodiment, an illuminator device, e.g., a single surface mount LED, is placed behind a lens and the light from the LED is directed through the lens to illuminate the face of the device and onto the wall plate.

In a further aspect, there is provided an apparatus for illuminating both a TR or non-TR receptacle that provides an illuminator device adapted to illuminate a ground blade opening in the socket using an electronic circuit with illuminator positioned to illuminate only the ground opening. In this embodiment, light from an illuminator device, e.g., a LED, is situated proximate or adjacent to the ground blade or prong cavity.

In a further aspect, there is provided an apparatus for illuminating both a TR and non-TR receptacle that provides an illuminator device adapted to illuminate socket and or face cover edges using an electronic circuit with illuminator positioned inside the receptacle enclosure. In this embodiment, a flexible printed circuit board (FPCB) may create edge lighting on the face of the receptacle.

In a further aspect, there is provided an apparatus for illuminating both a TR and non-TR receptacle that provides an illuminator device for illuminating a face cover and/or wall plate by means of inductive power coupled to the light illuminating circuit for illuminating circuit light sources placed in the face and wall plate. In this manner, power is directly supplied to a wall plate for illuminating itself.

Advantageously, the technology described herein may be used for illuminating a TR or non-TR receptacle, which may be in combination with one or more power outlets, switches, dimmers, sensors, lighting controls, and combinations thereof, in single or multi-gang varieties.

The above and other aspects, features and advantages of the invention will be more readily apparent from the description of the preferred embodiments taken in conjunction with the accompanying drawings and appended claims.

BRIEF DESCRIPTION OF THE DRAWINGS

The foregoing objects and advantages of the present invention may be more readily understood by one skilled in the art with reference being had to the following detailed description of several embodiments thereof, taken in conjunction with the accompanying drawings wherein like elements are designated by identical reference numerals throughout the several views, and in which.

DETAILED DESCRIPTION

Figure 2:
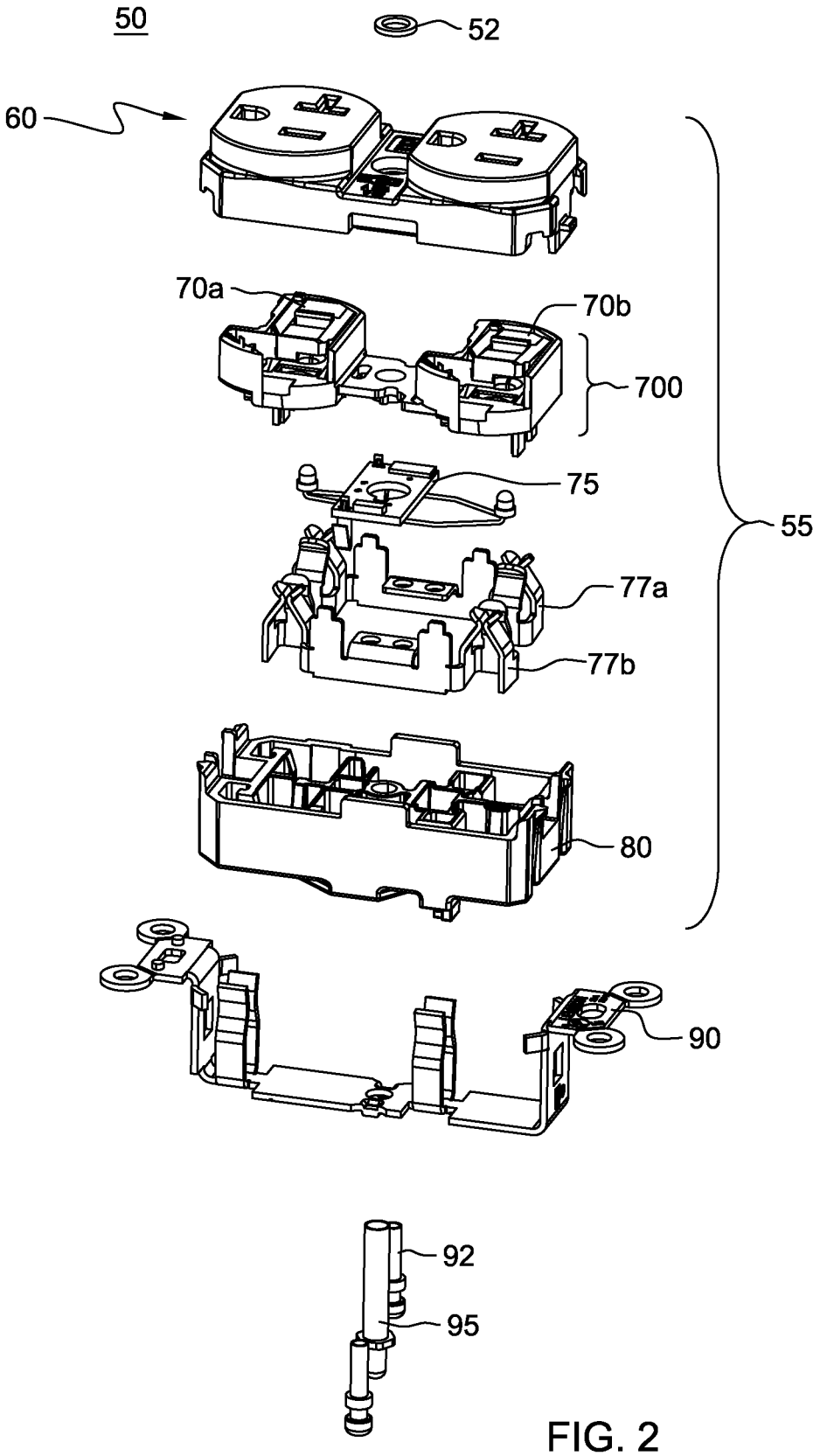
FIG. 2 illustrates an exploded view of an illuminated electrical receptacle according to a first embodiment of the present invention.

FIG. 2 illustrates an exploded view of an illuminated tamper proof or tamper resistant (TR) receptacle 50 according to a first preferred embodiment of the present invention. In the embodiment described by way of example herein, the receptacle 50 is shown as a duplex three-prong electrical receptacle for handling 20 amp current applications. However, it should be understood that the receptacle can be a one, two, or three-prong electrical receptacle or a receptacle having capabilities greater than that of a duplex receptacle. In addition, the receptacle may include ground fault circuit interrupter (GFCI) and/or surge suppression capabilities. Moreover, the receptacle can be selected to handle other current capacities such as 15 amp, 30 amp, 50 amp and other capacities. Further, while the description herein is provided with reference to an example power outlet receptacle 50 having sockets that receive a plug connected to an electrical load, it is equally applicable to other devices that have a receptacle that are in combination with, including, but not limited to, switches, dimmers, sensors, lighting controls, and combinations thereof, of single gang and multi-gang varieties.

Referring to FIG. 2 and as will be described in greater detail below, the receptacle 50 preferably includes a housing 55 including a cover 60 and a body 80, which preferably contains one or more light emitting sources for illuminating at least a portion of the receptacle 50. The cover 60 preferably includes one or more sockets 62 for receiving corresponding blades or prongs of a plug or adaptor (not shown). Within the housing 55, there is disposed beneath the cover 60, a tamper resistant platform assembly 700 including one or more TR platform sub-assemblies 70*a*, 70*b*, each sub-assembly having a TR mechanism aligned with the blade or prong openings of the socket. The TR platform sub-assembly 70*a*, 70*b* is preferably operatively situated beneath the respective blade openings to prevent insertion of a device within the aperture/openings of a respective socket. The receptacle 50 preferably also includes a printed circuit board (PCB) 75 having a circuit provided or coupled to a power source (not shown) that feeds power into circuit for powering one or more light emitting sources. The PCB 75 may be in the form of a rigid PCB, e.g., circuits formed on rigid (e.g., plastic) substrate, or of a flexible printed circuit board (FPCB).

Further, as shown in FIG. 2, the receptacle 50 preferably also includes respective conductive structures 77*a*, 77*b* provided and disposed in the body 80 to fit at or near an inner side wall of the housing 55. Conductive structures 77*a*, 77*b* are preferably coupled with a respective phased and neutral terminal of a power source, e.g., as supplied to a home, business or hospital, to provide respective hot or single phase power and neutral or return terminals within the receptacle. For example, FIG. 3 depicts an exploded view of an alternate receptacle 50' including a housing 80' of an alternate design that includes terminal screws for receiving power and conducting power to conductive terminals 47*a*, 47*b* within the receptacle.

Further, as shown in FIG. 2, the receptacle 50 preferably includes a metal plate or strap assembly 90 for providing a receptacle ground by connecting to a ground potential of a power source (not shown), and provides the conductive ground terminal structures within the housing. In one embodiment, as shown in the alternate receptacle 50' of FIG. 3, strap 90 provides ground terminals 47*c* within housing 80'. That is, in the alternate embodiment of FIG. 3, a terminal screw connects a ground conductor (not shown) to the mounting strap 90 thereby providing a ground potential at the ground contact terminals.

In the embodiment of FIG. 2, directed to the Lev-Lok® design, a ground pin 95 is provided that connects the strap 90 at back of the receptacle to a ground potential to establish a ground potential at the ground contact terminals within the housing, via the strap, thereby obviating the need for a terminal screw.

Figure 3:
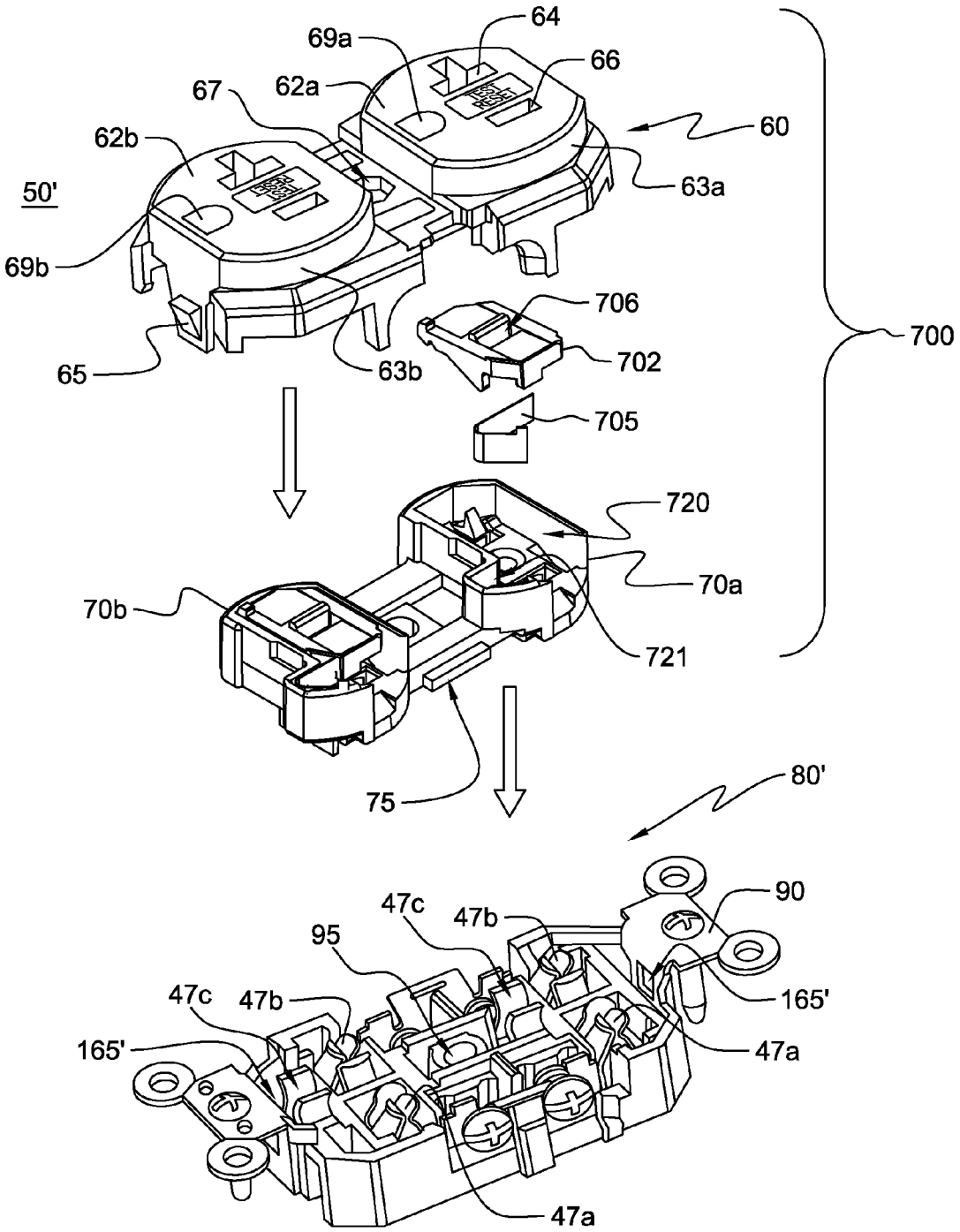
FIG. 3 illustrates a partially exploded view of a receptacle according to one embodiment.

FIG. 3 particularly depicts an exploded view of the alternate receptacle 50' showing in more detail the body 80', cover 60, a TR platform assembly 700 and the PCB 75 having a circuit for powering one or more light emitting sources according to one embodiment. The cover 60 may be solid, translucent or partially translucent and may include snap-fit structures 65 at each distal end for coupling to or otherwise engaging respective receiving structures 165' at respective ends of a solid, translucent or partially translucent body 80' to provide a secure housing or enclosure for the electrical device, e.g., power outlet. In one embodiment, the body and cover material may be manufactured from thermoplastic such as, for example, nylon, polycarbonate, etc.

As known in the art and as shown in FIG. 3, the cover 60 may include one or more raised socket structures 62*a*, 62*b*, having a surface including blade or prong opening 64, 66 for receiving corresponding blades or prongs of a plug or power adaptor. In one embodiment, each socket structure 62*a*, 62*b* includes socket side edges, such as edges 63*a*, 63*b*. For purposes of description, each raised socket 62*a*, 62*b* includes blade or prong openings 64, 66 that align with electrically conductive terminals 47*a*, 47*b* provided within receptacle housing 55 for receiving and engaging blades or prongs of a plug or like-plug-adaptor to receive phased electrical power from electrical terminals, e.g., within an electrical box. As shown in FIG. 3, the cover 60, and/or each raised socket 62*a*, 62*b* may further include a ground blade aperture or opening 69*a*, 69*b* that are aligned with respective ground terminals 47*c* disposed within the body 80' that receive a respective ground prong or blade of a plug or adaptor.

Figure 3A:
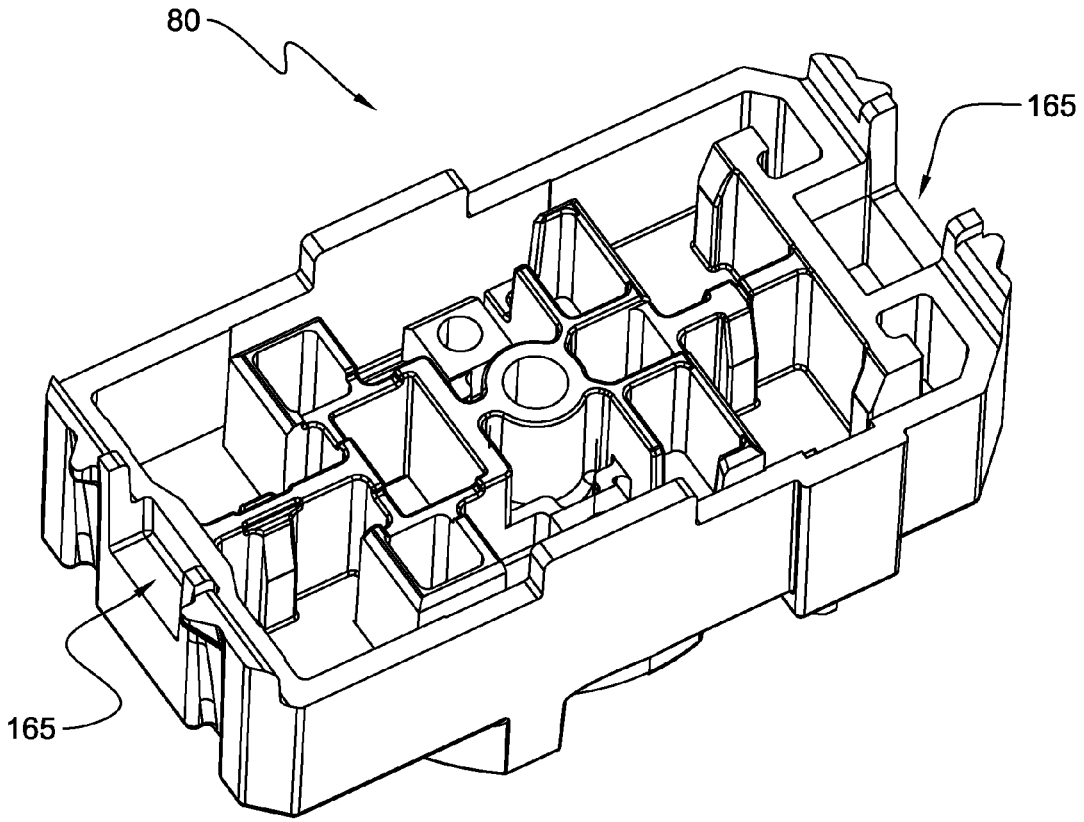
FIG. 3A illustrates a detailed view of a body 80 for the receptacle housing 55 such as shown in FIG. 2.

Returning to the embodiment of receptacle 50 shown in FIG. 2, each of the terminal structures 77*a*, 77*b* provide respective phase (Hot) terminals, and neutral terminals 47*a*, 47*b* for receiving blades or prongs, of a plug or like adaptor for use in powering an electrical device. In one embodiment, these conductive structures 77 may include screw terminals for receiving, at the back of the housing, direct wire connections from power terminals, as supplied to homes, businesses or hospitals. In another embodiment, depicted in FIG. 3A showing the body 80 implemented in the LEV-LOK® design (of FIG. 2), the snap-fit structures 65 at each distal end of cover assembly (shown in FIG. 3) are accommodated by respective receiving structures 165 formed at respective ends of body 80. Furthermore, in the LEV-LOK® design, terminal structures (e.g., pins) are provided at the back of the body to directly receive respective Hot (phased) and Neutral signals from a power source within a wall structure, and conduct respective power to respective terminal structures 47*a*, 47*b* and 47*c*. For example, as shown in FIG. 6A illustrating a partially exploded underside view of the receptacle shown in FIG. 2, there are provided conductive structures 97 including a grounding center pin 95 and hot and neutral pins 92 at the back of the housing 80, that mate with interlocking complementary structures for receiving phased and neutral signals, e.g., as known in current LEV-LOK® designs. For example, in the manner as described in co-pending U.S. Patent Application Nos. 2010/0120274, incorporated by reference herein, the hot and neutral pins 92 communicate with respective conductive terminals 47*a* providing hot (phase) signals and neutral terminals 47*b*, while the center pin 95 communicates with strap 90 providing ground at terminals 47*c* (FIG. 3).

With respect to the TR platform sub-assemblies 70*a, b*, in one embodiment as shown in FIG. 3, separate individual TR platforms 70*a*, 70*b* are provided, each being aligned and disposed beneath each corresponding socket 62*a*, 62*b* structure and adapted to fit within a respective socket. As described in commonly-owned, co-pending U.S. Pat. No. 7,820,909, the entire contents and disclosure of which is incorporated by reference as if fully set forth herein, each individual platform 70*a*, 70*b* is pressed or snug-fit within a respective cover socket and configured with structures forming pockets or cavities 720, 721 that accommodate a respective shutter or slider 702, and a slider biasing mechanism such as a leaf spring 705. In one embodiment, each individual platform 70*a*, 70*b* and slider (or shutter) 702 is manufactured from a translucent or partially translucent material such as, for example, nylon, polycarbonate, etc. Each respective slider 702 is aligned with the at least two blade or terminal openings 64, 66 of a respective socket, and in the manner as described in commonly-owned, co-pending U.S. Pat. No. 7,820,909, operatively controlled by slider biasing mechanism to prevent or permit insertion of an item within the openings 64, 66 of a respective socket. More particularly, a slider aperture 706 is included in slider 705 operative to enable one blade or prong to be inserted through to make contact with respective receptacle conductive terminals in the base of the TR receptacle 50 in a manner as will be explained in greater detail herein below.

Figure 4:
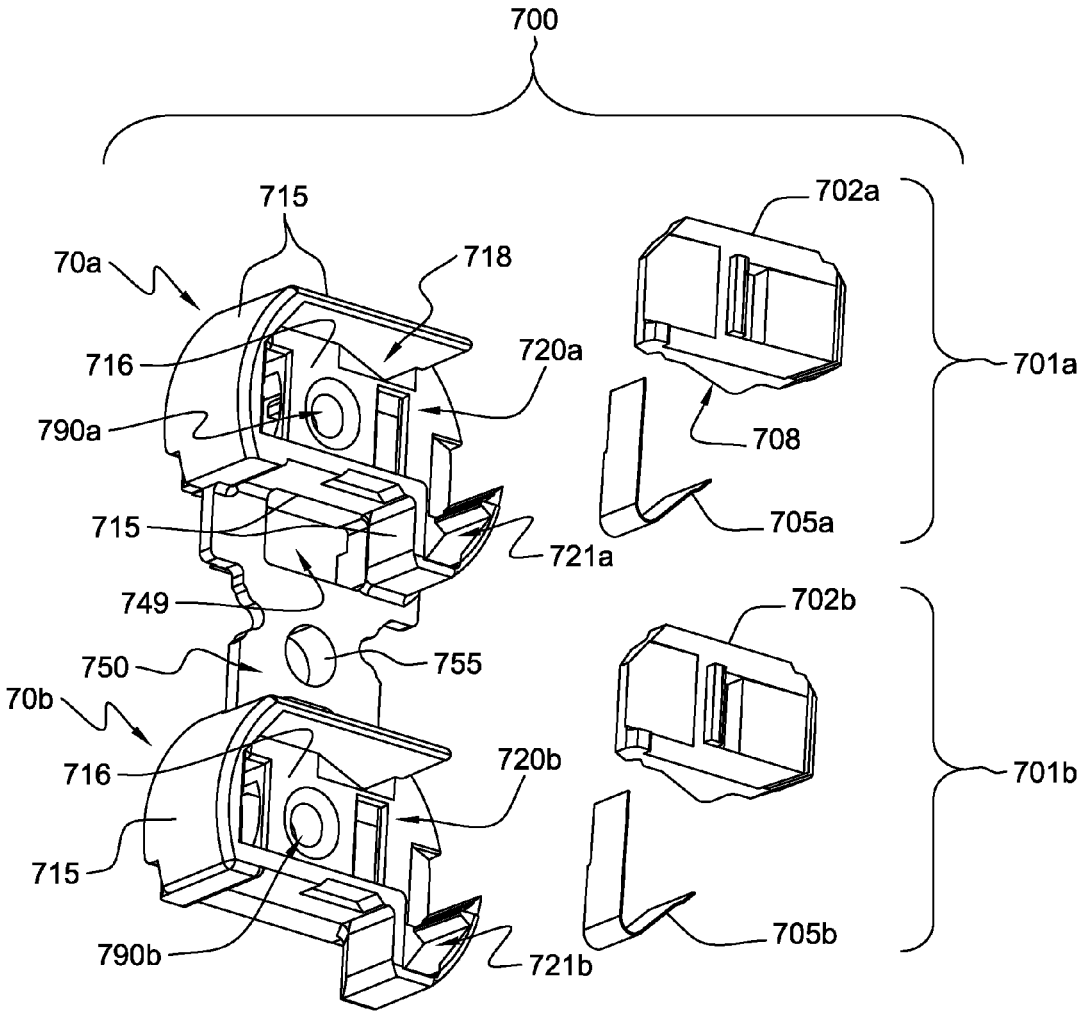
FIG. 4 illustrates a first exemplary embodiment of a TR platform sub-assembly that may be used in connection with the receptacle shown in FIG. 2.
Figure 5:
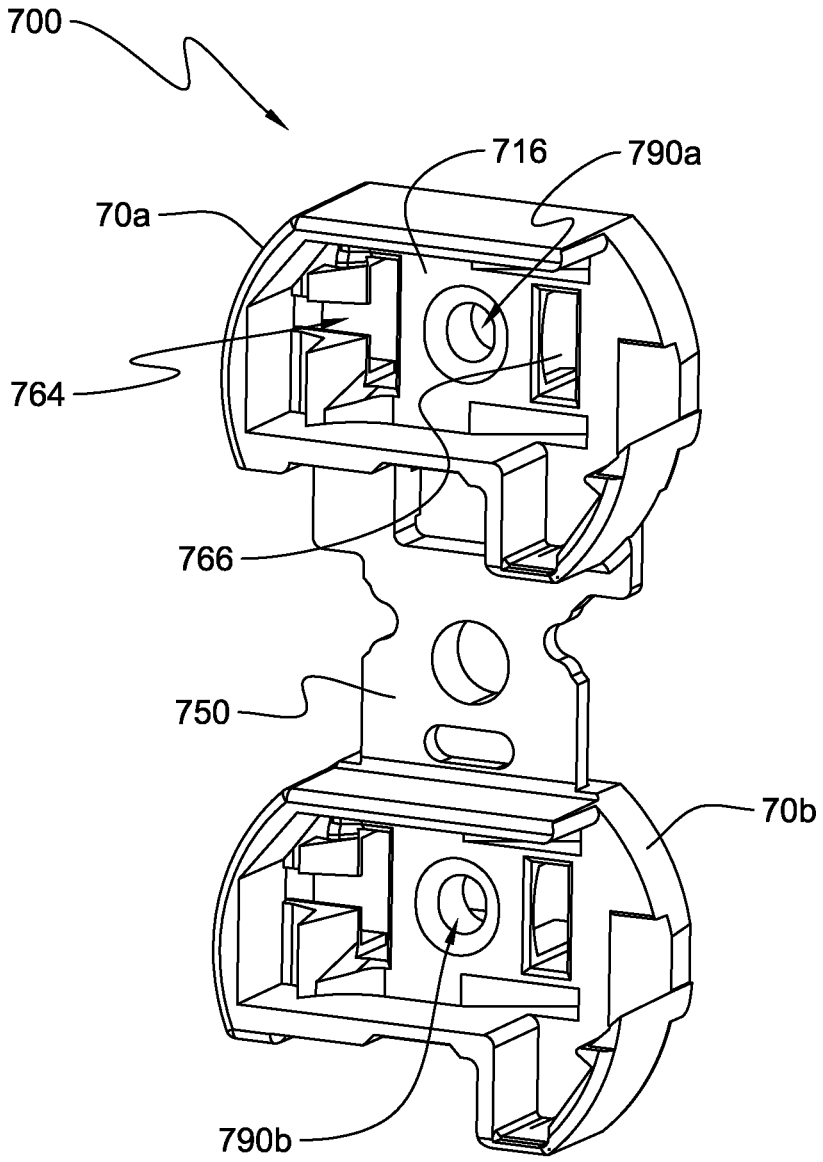
FIG. 5 illustrates an alternate view of the TR platform sub-assembly of FIG. 4 that may be used in connection with the receptacle shown in FIG. 2.

As shown in FIGS. 4 and 5, the TR platform sub-assembly 700 includes platform sub-assemblies 70*a*, 70*b* connected by an intermediary member or plate 750. In one embodiment, platform sub-assembly 700 including intermediary plate 750 is of unitary structure, adapted to fit inside the housing 55 and beneath the cover 60 such that each platform sub-assembly 70*a*, 70*b* at a respective end aligns with a respective socket and adapted for press or snug-fit within each socket. The intermediary plate 750 includes a through-hole 755 for accommodating a central ground bushing 95 (such as shown in FIG. 2) that is used to secure the cover 60 and strap 90 to the receptacle body 80 between the sockets near center of the receptacle in the two-gang design shown in FIG. 3.

More particularly, whether provided as individual platforms sub-assemblies 70*a*, 70*b* (FIG. 3), or connected by intermediary plate 750 in the integrated platform sub-assembly 700 (FIG. 4), each platform 70*a*, 70*b* includes a platform base 716 and structures 715 defining a first pocket or cavity 720*a*, 720*b*, within which each respective TR slider 702*a*, 702*b* is seated, and defining an adjacent second pocket or cavity 721*a*, 721*b* within which a respective biasing member (e.g., leaf spring) 705*a*, 705*b* is supported that operates to bias each respective slider 702*a*, 702*b* to a first home or blocking position within pocket cavity of the platform.

More particularly, leaf spring 705 is disposed to engage the slider 702 in the first position wherein the slider aperture 706 is misaligned with either aperture, 64 or 66, in the cover 60. Thus, when slider 702 is initially in this first position, the slider blocks each respective blade or prong openings 64, 66, in the cover 60. In operation, when a conventional electrical plug having a pair of prongs or blades are inserted into the cover 60 of receptacle 50 through the openings in cover 60, the slider blocks entry into the receptacle terminals formed by contacts 47 (See FIG. 3). As the prongs or blades of a plug are inserted further, a rib structure of the slider 702 slides into a second position down into the cavity 720 such that slider aperture 706 comes into alignment with one of the prong openings.

That is, just prior to having a pair of blades or prongs inserted through the apertures 64, 66 in cover 60, slider 702 blocks direct entry into the receptacle terminals 64, 66. As prongs are inserted further into the cavity, formed ribs 708 of slider 702 (FIG. 4) slide into a second position down respective slopes or camming surfaces of recesses 718 formed in each platform 70*a*, 70*b* such that aperture 706 of slider 702 comes into alignment with one of the prongs. In one embodiment, as described in co-pending U.S. Pat. No. 7,820,909, the ribs of slider 702 are urged to slide down slope of recess within the pocket thereby bringing aperture 706 of slider 702 in alignment with one of prongs at a second position (i.e., an alignment position). With slider 702 transitioned completely to the second position, slider 702 aligns with the cover apertures 64, 65 to allow a first prong of the prongs to bypass along a side of slider and a second prong of prongs to pass through aperture 706 of slider 702.

As such, the width of slider 702 is designed such that another prong gains clearance straight through to the receptacle terminal when aperture 706 of slider 702 aligns with the aperture in cover 60. The first and second prongs (not shown) engage with receptacle terminals 47*a,b* (FIG. 3) to complete electrical contact with once slider 702 has transitioned completely to the second position.

As slider 702 transitions from the first position to the second position, slider 702 acts on biasing member 705 thereby biasing member 705. Biasing member 705 is designed to retract to its original position after being biased similar to a conventional spring. Thus, when the prongs are withdrawn, the biasing force of the leaf spring 705 urges slider 702 back to the first misaligned position.

Further, whether platform sub-assemblies 70*a*, 70*b* are separately seated individually within the cover 60 as standalone devices or integrated via an intermediate connecting member 750 in a unitary design 700 (FIG. 4), each platform base 716 as shown in FIG. 5 includes respective blade or prong openings 764, 766, such that, when assembled within the cover 60, they are aligned with the socket blade openings 64, 66 to receive polarized blades of a plug inserted in the socket 62 that are adapted to electrically mate with respective conductive terminals 47*a*, 47*b* in the housing 55. As further shown in FIGS. 4 and 8, intermediate plate 750 includes an opening 749 such that, when assembled within the cover 60, this opening 749 aligns with the cover socket opening 69, e.g., blade opening 69*b* as shown in FIG. 4, to receive a polarized ground blade of a plug inserted in the socket that are adapted to electrically mate with respective conductive terminals in the housing, e.g., terminal 47*c* shown in FIG. 1.

Further, each platform base 716 includes a respective aperture or through-hole 790*a*, 790*b* situated in the platform base 716 and aligned between the blade openings 764, 766 formed in the platform sub-assembly 700 directly beneath a respective slider 702. Each through-hole 790*a*, 790*b* is dimensioned to accommodate placement of a light source 72, e.g., a light emitting device (LED), bulb, or like illuminating source that receives power via a printed circuit board (PCB), for example, such that, as long as the receptacle is powered, the light emitting device illuminates. More particularly, the illuminating light source 72 (e.g., LED) is received within each through-hole 790*a*, 790*b* and positioned within the platform base 716 at a distance beneath the slider 702 such that when power is delivered to the receptacle powering PCB circuitry, light emanating from the LED source forms a cone of a light intensity and lumen power sufficient for illuminating the slider 702 of the TR device from within the cavity. In one embodiment, an LED is disposed within each respective aperture or through-hole 790*a*, 790*b* in a manner substantially orthogonal to a plane of the cover surface/socket for directly illuminating respective translucent or partially translucent sliders 702*a*, 702*b* supported by the respective platform assembly. It is understood that, alternately, the through-holes (aperture) and consequently the LEDs can be situated at an angle with respect to the base of the aperture.

Figure 6:
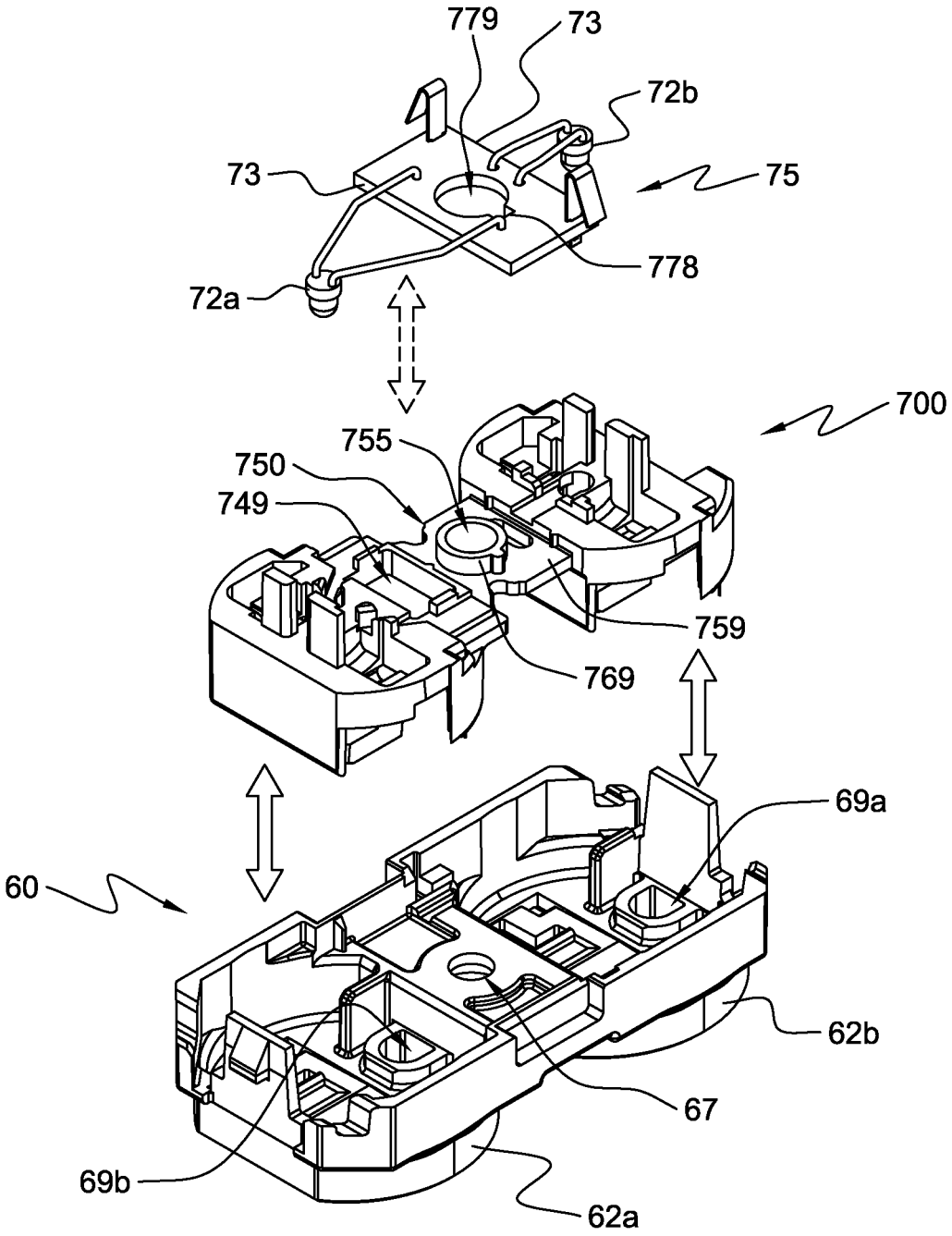
FIG. 6 illustrates an exploded underside view of the cover, TR platform sub-assembly (FIG. 5) and illumination circuitry of the receptacle shown in FIG. 2.
Figure 6A:
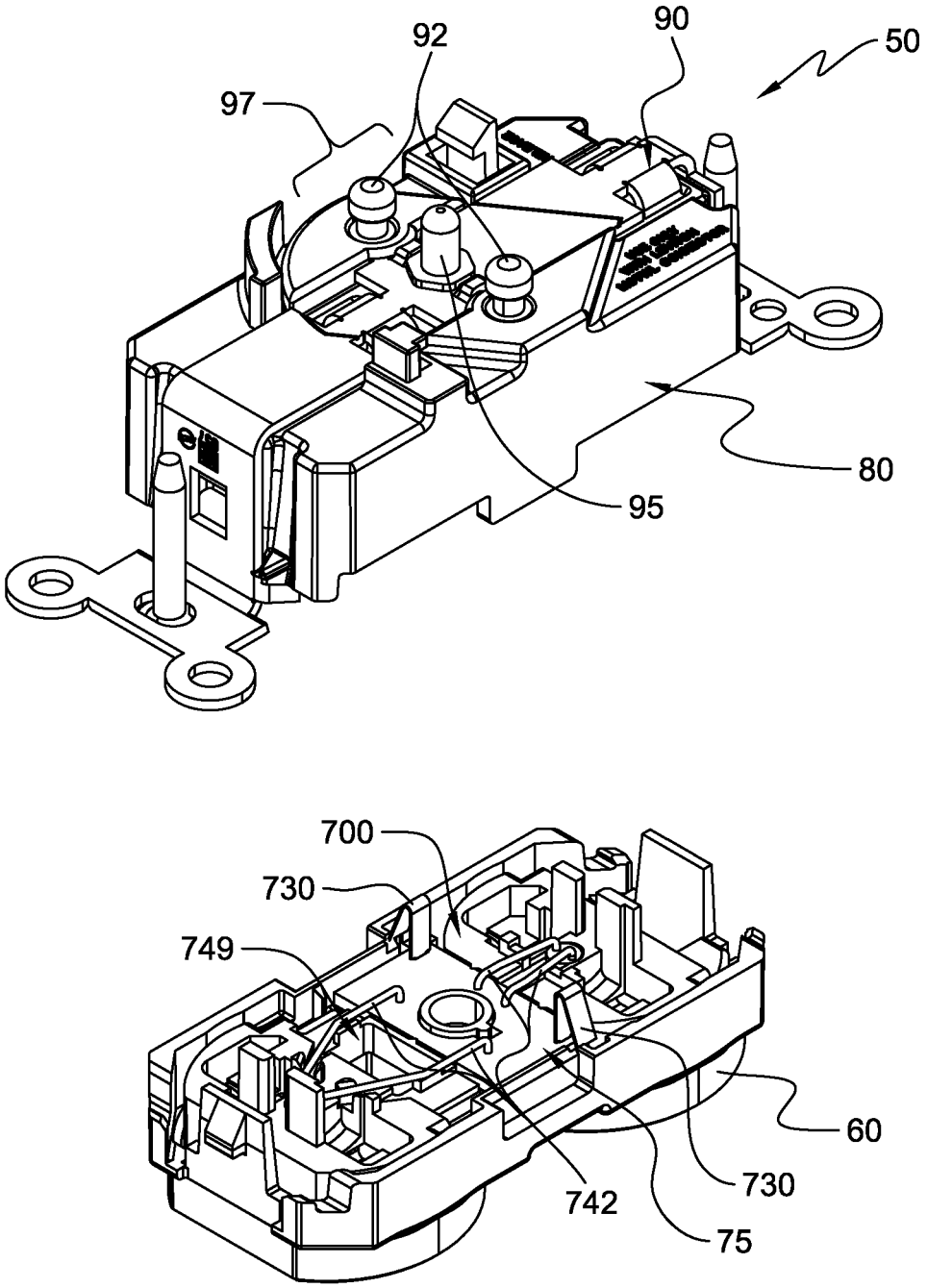
FIG. 6A illustrates a partially exploded underside view of the receptacle shown in FIG. 2.

FIG. 6 shows an underside view of both the cover 60 and TR platform assembly 700 adapted for seating within the cover 60 as indicated by arrows. In one embodiment, the connecting member 750 provides a platform 759 for seating a rigid or flex PCB 75 having light illuminating circuitry for powering light emitting sources (e.g., LEDs) 72*a*, 72*b* corresponding to respective sockets 62*a*, 62*b*. In one embodiment, intermediary plate 750 includes an opening 755 aligned with the bushing pin hole 67 formed in the cover 60 and further, aligned with the hole 76 formed at the bottom of the housing 55 for accommodating the center bushing, such as shown in FIG. 3.

In one embodiment, the underside of the intermediary connecting member 750 of platform assembly 700 includes raised guide ridges or edges 769 formed circumferentially about opening 755 in order to mate with a corresponding aperture or opening 779 formed in the PCB 75 for mounting the PCB 75 to the TR platform assembly 700, more specifically, to the underside of the intermediary connecting member 750. While the guide ridges 769 are shown circumferentially around through-hole opening 755, any equivalent structure may be provided on the plate 750 to enable the PCB 75 to engage the TR platform assembly 700 and more specifically, the underside of the intermediary connecting member 750.

FIG. 6A illustrates a back view of a partially assembled TR receptacle 50 showing provision of housing 80 adapted to mate with cover 60 and platform sub-assembly 700 and depicting conductive structures 97 for receiving power to illuminate the receptacle in one embodiment. As shown in FIG. 6A, the PCB 75 is fitted to the underside of the intermediary connecting member 750 of platform assembly 700. The relative position of the light emitting sources 72*a*, 72*b* extending from the PCB 75 by conductors 742 corresponds to respective platforms 70*a*, 70*b* of platform sub-assembly 700 in alignment with openings 790*a*, 790*b* formed at the base of platform assemblies 70*a*, 70*b* that align with TR slider for preventing access to blade openings in respective sockets 62*a*, 62*b*. In one embodiment, shown in FIG. 6, PCB 75 includes a corresponding opening 779 dimensioned to accommodate a snap- or press-fit of the PCB onto the platform 759 on the guide ridges 769 formed underside of the connecting member 750.

Figure 8:
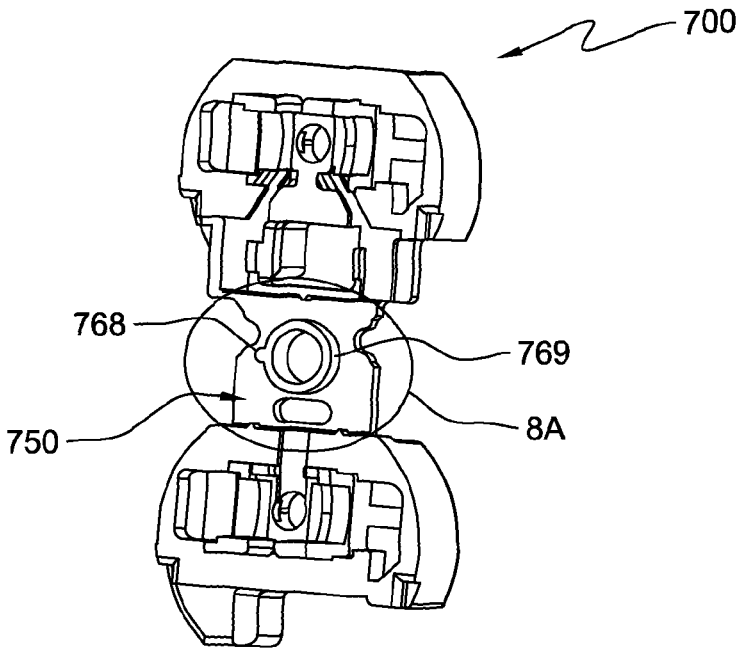
FIG. 8 illustrates a detailed underside view of the TR platform sub-assembly of FIG. 5.

In one embodiment, as further shown in FIG. 8 depicting a detailed underside view of the platform sub-assembly shown in FIG. 5, the guide ridges 769 shown surrounding through-hole opening 755 includes a tab or ribbed portion 768 to ensure correct orientation of the PCB assembly 75 upon the intermediary plate 750. As shown in further detail of PCB assembly 75 of FIG. 9A, through hole 779 formed in the PCB includes a complementary shaped notch 778 to accommodate the tab portion 768 when press- or snap-fitting the PCB assembly 75 upon guide ridges 769 of intermediary plate 750.

Figure 8A:
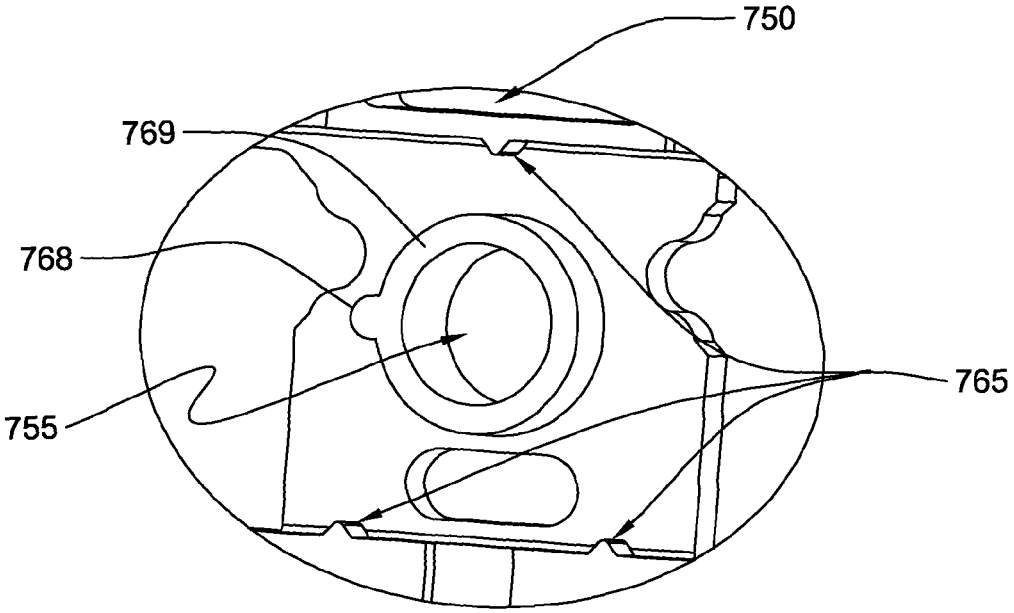
FIG. 8A illustrates a partial, detailed view of the underside of the platform sub-assembly shown in FIG. 8.

FIG. 8A illustrates a partial detailed view of the platform sub-assembly shown in FIG. 8. In particular, FIG. 8A illustrates an underside of intermediary plate 750 including two or more PCB engaging structures, e.g., lips or ribs 765, that engage the edges 73 of the PCB 75 such that the PCB 75 may be more securely press- or snap-fit to platform 759 such as shown in the manner as indicated by the dashed-line arrow in FIG. 6.

It should be understood that the connecting plate 750 does not necessarily require guide ridges for enabling press-fit of the PCB; any complementary or engaging structures formed on the both connecting plate and the PCB can be used to mount the PCB onto the plate 750. For example, FIG. 10 illustrates an exploded underside perspective view of the PCB (shown in FIGS. 9 and 9A) and the TR platform sub-assembly 700' configured according an alternate embodiment. That is, as shown in FIG. 10, in an alternate embodiment of platform sub-assembly 700' shown in FIG. 8A, the intermediary connecting plate 750' connecting platform sub-assemblies 70*a*, 70*b* includes ribs 780 including a section 782 defining a platform section 785 upon which the PCB 75 is mounted or fit.

It should be understood that, in a further alternative embodiment, the intermediary connecting plate connecting sub-assemblies 70*a*, 70*b*, may be omitted, and the PCB or FPCB may be mounted to the cover by any means now or hereafter known.

Figure 1:
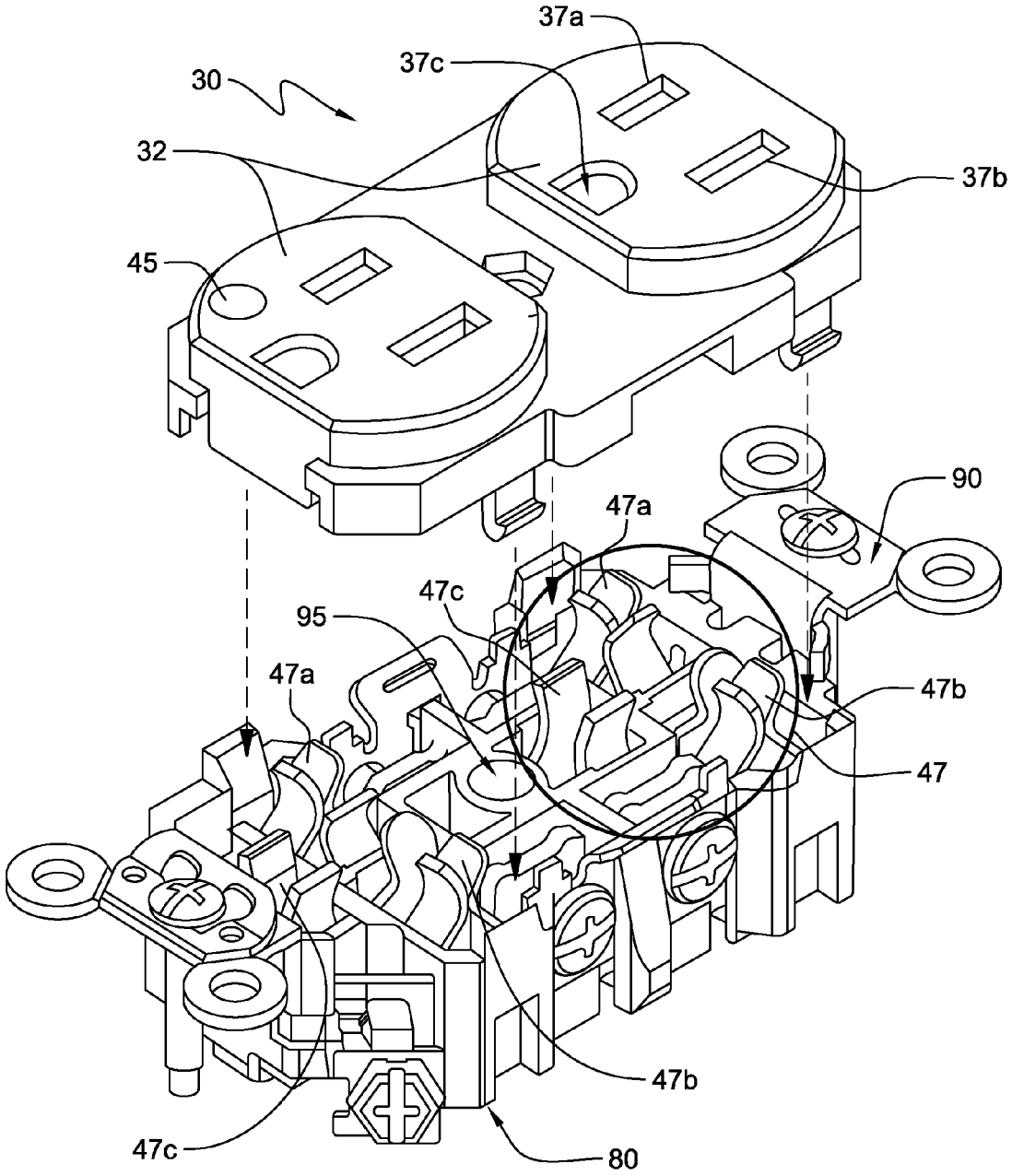
FIG. 1 PRIOR ART
FIG. 1 illustrates an exploded view of a conventional illuminated electrical receptacle.
Figure 9:
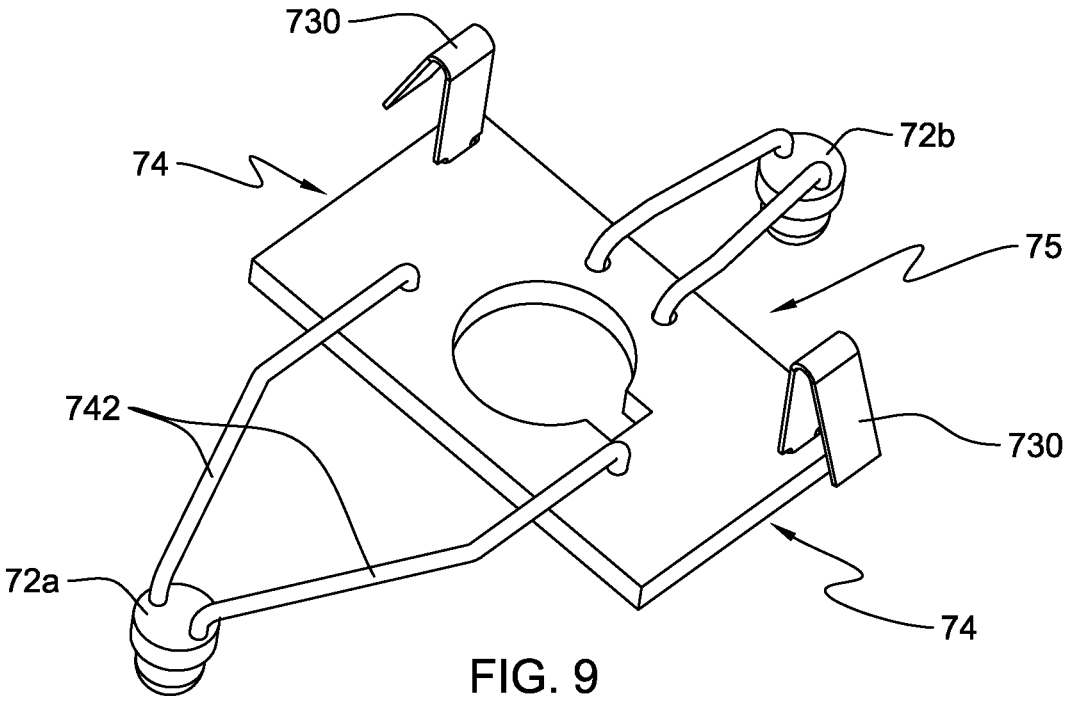
FIG. 9 illustrates a detailed top perspective view of a print circuit board (PCB) according to an exemplary embodiment.
Figure 9A:
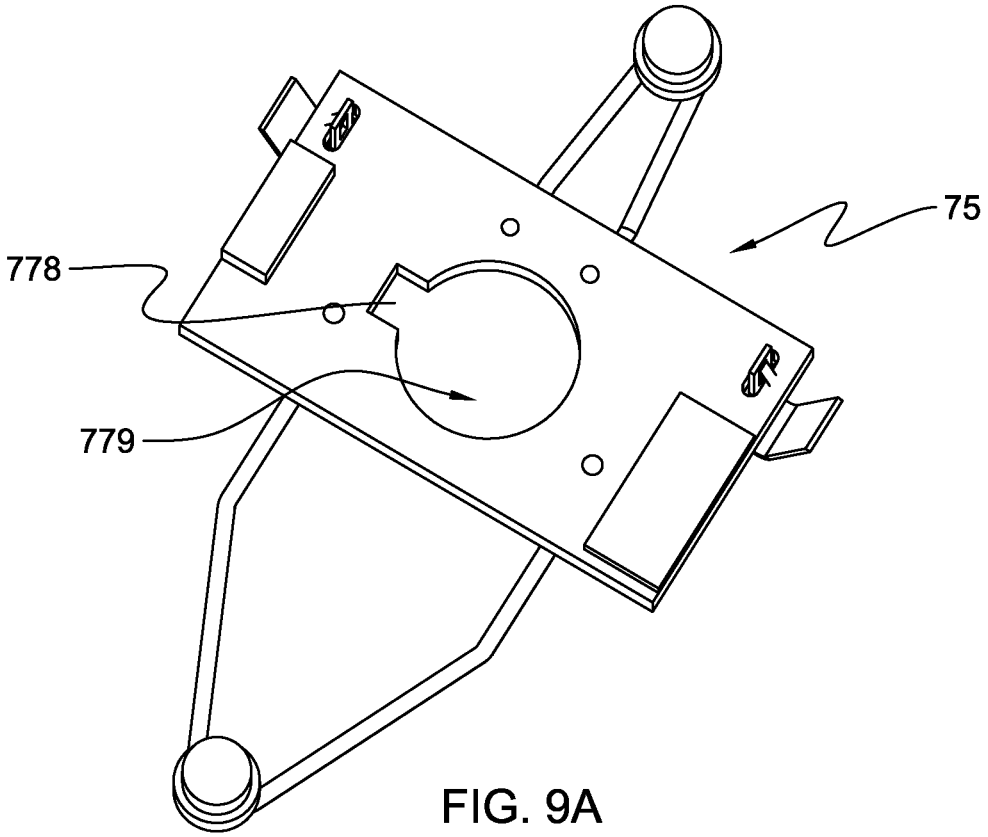
FIG. 9A illustrates a detailed bottom perspective view of the PCB shown in FIG. 9.
Figure 10:
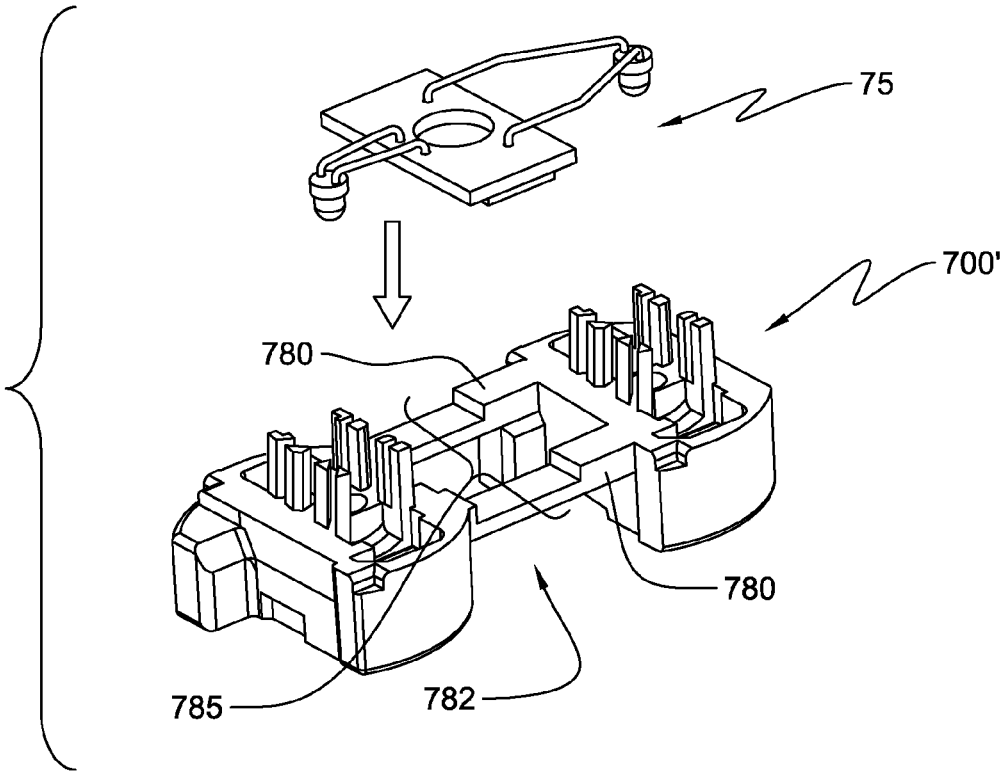
FIG. 10 illustrates an exploded underside perspective view of the PCB (shown in FIGS. 9 and 9A) and a TR platform sub-assembly configured according an alternate embodiment.

FIG. 9 illustrates a detailed top perspective view of a printed circuit board (e.g., PCB 75) according to one embodiment, and FIG. 9A illustrates a detailed bottom perspective view of the PCB 75 shown in FIG. 9 according to one embodiment. As shown in FIG. 9, PCB 75 includes spring clip contacts 730 formed at or proximate respective opposite ends 74 of the PCB that correspond to and are adapted to conductively connect with respective the Hot (phase) and Neutral terminals in the final assembly. For example, in the partially assembled view of FIG. 6A, the spring clips 730 engage conductive structures 77 (as shown in FIG. 1) located at opposite sides of the housing that communicate with power receiving pins 92. When the receptacle is powered these clips 730 provide power to the board and light the LEDs 72*a*, 72*b*. It should be understood however that the PCB or FPCB may be coupled to the Hot (phase) and Neutral terminals by any means known in the art including, for example, wire leads, welding, etc.

In alternate embodiments, the PCB 75 may be provided on a flexible material, e.g., a polyimide and polyester flexible printed circuit board (FPCB) of the one-sided or two-sided variety. Further, in the flexible PCB design, there would likewise be implemented surface mount (SMD) components, e.g., including one or more light emitting sources 72*a*, 72*b*, connected by conductive wires, e.g., a metal such as copper.

In a further alternate embodiment, rather than a rigid or flexible PCB, a hard-wired assembly forming an electrical circuit(s) including one or more light emitting sources 72*a*, 72*b* and/or other discrete or IC components housed within the receptacle for connection across Hot and Neutral terminals of the receptacle is implemented.

Figure 11:
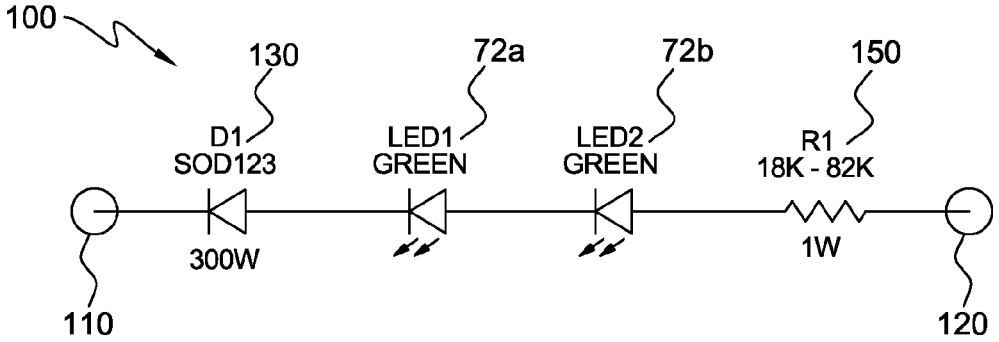
FIG. 11 illustrates an exemplary illumination circuit for receiving power to illuminate the light emitting sources located in the receptacle shown in FIG. 2.

FIG. 11 illustrates an exemplary illumination circuit for receiving power to illuminate the light emitting sources located in the receptacle shown in FIG. 2. As shown in FIG. 11, an illumination circuit 100 is connected across respective Hot and Neutral terminals 110, 120, to receive power for illuminating light emitting sources as long as power is supplied to the receptacle. The illuminator circuit 100, whether connected as discrete wired circuit components and conductive elements (e.g., wires), or configured on a rigid or flexible PCB 75 assembly within the receptacle housing as described herein, includes a series connection of one or more light emitting sources, e.g., light emitting diodes, LEDs 72*a*, 72*b*, and processing components, e.g., a series resistor 150, a rectifier such as a diode 130, in a manner suitable for powering (illuminating) the one or more LEDs. Optionally, there may be included additionally connected electronic control circuitry, e.g., passive or active circuitry (not shown), which may be implemented or required for causing a light blinking or other light conveyance, e.g., for indicating a particular condition(s).

In the embodiments of a rigid PCB board 75 shown in FIG. 9 and in the exploded view of a final assembly 50 of FIG. 6A, the one or more light emitting sources of the circuit are extended by conductive wires 742, e.g., LED leads that are insulated and heat shrunk, so that each light emitting source aligns with and are received within respective openings, e.g., apertures 790*a*, 790*b*, at the bottom of respective platform sub-assemblies 70*a*, 70*b*. That is, returning to FIG. 6, in one embodiment, conductive wires or leads 742 of sufficient dimension connect respective terminals of each one or more light emitting source 72*a*, 72*b* to enable each light source to extend beyond the edge 73 of the PCB 75 to illuminate, from within in the platform cavity, the translucent or transparent TR slider in the receptacle. The location of these light emitting sources of the circuit 100 are extended by conductive wires 742 in a manner so as to avoid interference with any plug or blade opening, such as ground plug opening 749 formed in intermediary plate 750.

Figure 7:
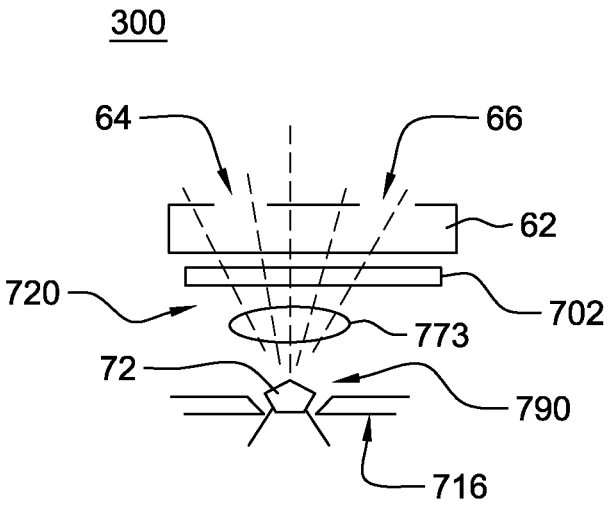
FIG. 7 illustrates a partial cross-sectional view of the receptacle shown in FIG. 2, including an LED in the base of the platform assembly.
Figure 7A:
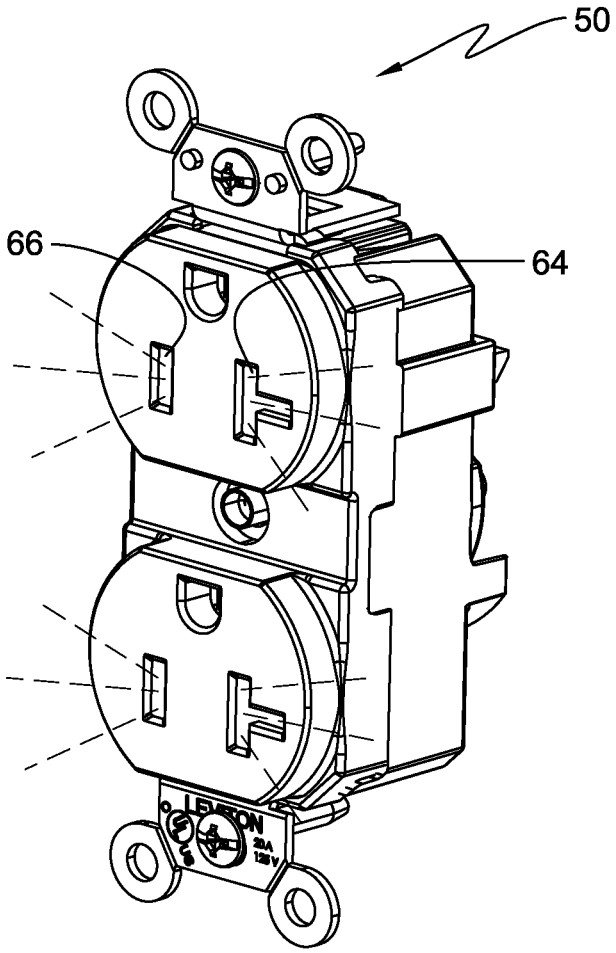
FIG. 7A illustrates a perspective view of the receptacle shown in FIG. 2 with the resulting light illuminating from the receptacle.

FIG. 7 illustrates a partial cross-sectional view of the receptacle shown in FIG. 2 showing LED 72 extending fully or partially through the base 716 of the platform assembly 70 within cavity 720. In one embodiment, a resultant assembly 300 is depicted showing LED 72 extending perpendicular to and partially through opening in the base 716 of the platform assembly 70 within a TR platform cavity. The LED 72 is powered by illumination circuit to generate a cone of light 773 sufficient to illuminate the translucent or transparent slider 702 of the TR assembly. LEDs 72 are particularly configured to generate a cone of light of sufficient intensity (i.e., lumens) such that it may be observed through the blade openings 64, 66 to indicate to viewers a condition of the receptacle, e.g., indicate the receptacle is receiving power, such as shown FIG. 7A depicting a perspective view of assembled receptacle 50 of FIG. 2, in addition to indicating presence of a TR receptacle. As shown in FIG. 7, the shape of the aperture 790 may be a conic section to ensure diffusion of light toward the TR slider.

Figure 12:
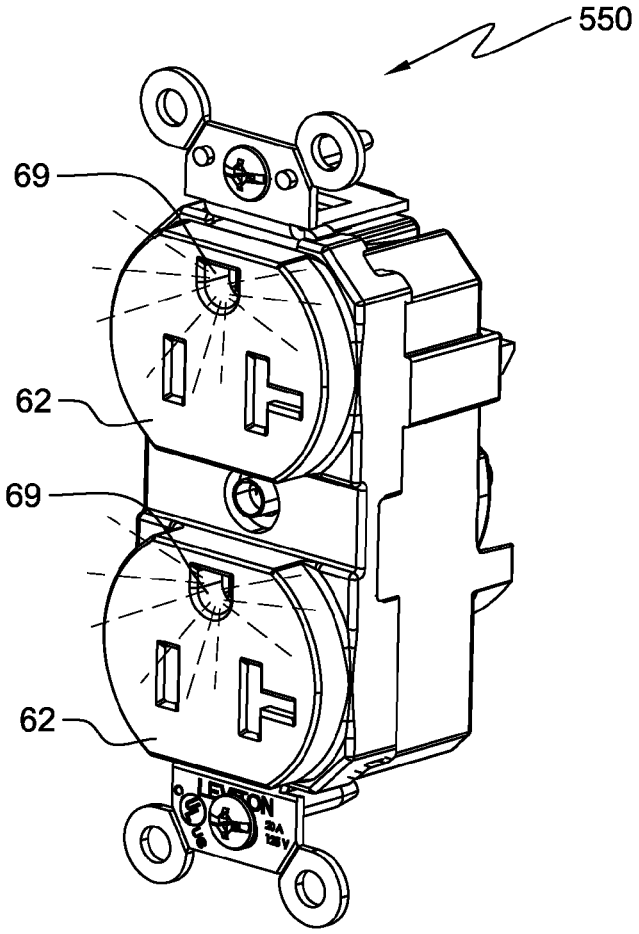
FIG. 12 illustrates a perspective view of an illuminated electrical receptacle according to a second exemplary embodiment of the present invention.
Figure 12A:
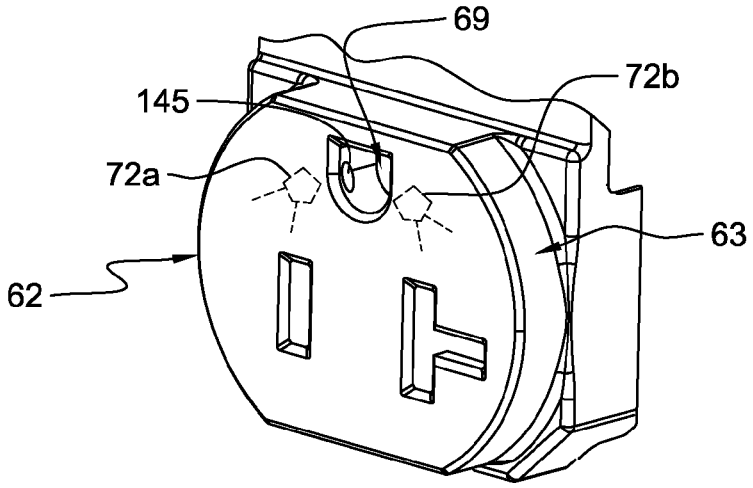
FIG. 12A illustrates a detailed view of a socket formed in the receptacle shown in FIG. 12.

FIG. 12 illustrates a perspective view of an illuminated electrical TR or non-TR receptacle according to a second exemplary embodiment of the present invention. FIG. 12A illustrates a detailed view of a socket formed in the receptacle shown in FIG. 12. Referring to FIGS. 12 and 12A, in a further embodiment, whether configured as a FLEX PCB or PC board assembly 75 or, a hard-wired assembly including light illumination circuitry 100, the receptacle 550 may include an illuminating light emitting source, e.g., LED, disposed at or near each ground prong opening of the cover assembly within the housing and adapted to exclusively illuminate only the ground openings 69. In this embodiment, light from the illuminator device, e.g., LED, is directed solely to the ground pin cavity or prong opening 69 formed in the cover. In this embodiment, light can be observed emanating from the ground blade opening 69 formed in each socket 62 or cover.

The light emitting source (e.g., LED) may be extended by connecting leads such that the LED 72*a* is placed within or near the interior of the receptacle proximate socket 62 of the receptacle at or near the ground prong opening 69 formed in the cover. In one embodiment, a thinned clear plastic wall section 145 may be provided at or in the prong opening 69 and an LED, e.g., LED 72*a*, is situated adjacent to or abutting the wall section 145. As shown in FIG. 12A, LED 72*a* is situated adjacent to the thinned clear plastic wall section 145 in a manner such that the LED does not interfere with the insertion of a ground prong of a plug or adaptor. In the view shown, additional LEDs, e.g., LED 72*b*, may be provided in similar orientation with respect to the plug opening 69. As the blade opening 69 receives a ground prong of an electrical adaptor, the LED or any other light source should not be situated directly underneath the opening. Thus, for example, as shown in FIG. 12A, approximate placement locations of one or more LEDs 72*a*, 72*b* are shown proximate the ground blade opening 69, for example, at an angle with respect to an axis of the ground prong opening in the receptacle. Thus, when powered by the illumination circuit 100, light is provided to the ground prong opening 69 sufficient to illuminate only the ground pin opening 69 in the face of the cover. Each LED 72*a*, 72*b*, 72*c* is configured to generate a cone of light of sufficient intensity (i.e., lumens) such that it may be observed through the ground blade openings to indicate a condition of the receptacle, e.g., indicate that the receptacle is receiving power.

In one embodiment, the conductive ground terminals that align with each respective blade opening 69 may be formed within a compartment that may be sealed within the receptacle such that no light emanating from a LED, e.g., 72*a*, 72*b* can illuminate any other blade opening. Thus, light will emanate exclusively from ground pin opening 69 as shown in FIG. 12.

Figure 13:
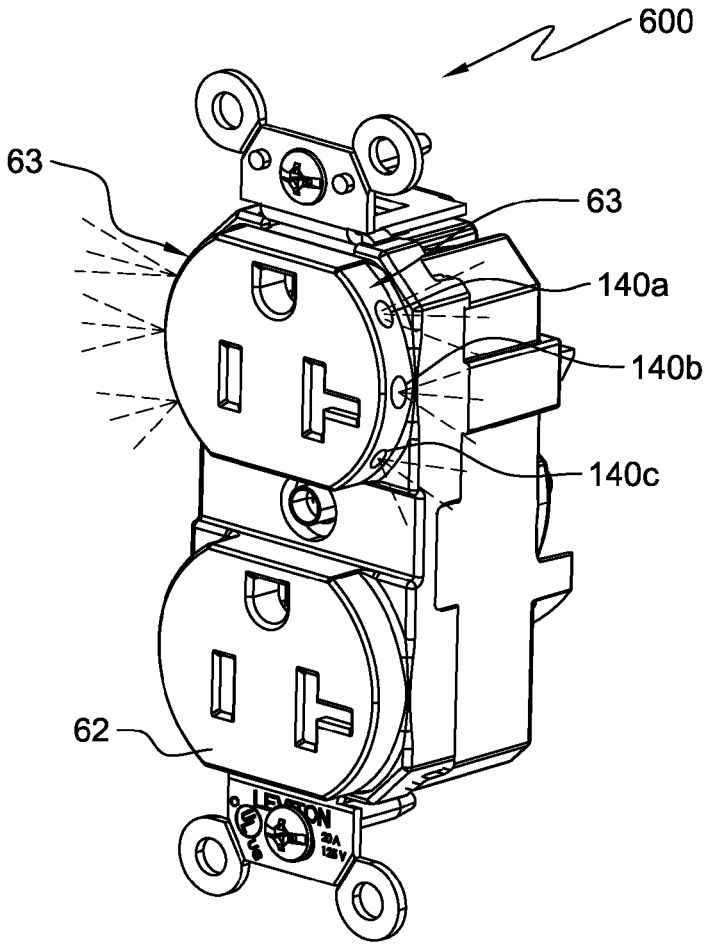
FIG. 13 illustrates a perspective view of an illuminated electrical receptacle according to a third exemplary embodiment of the present invention.
Figure 13A:
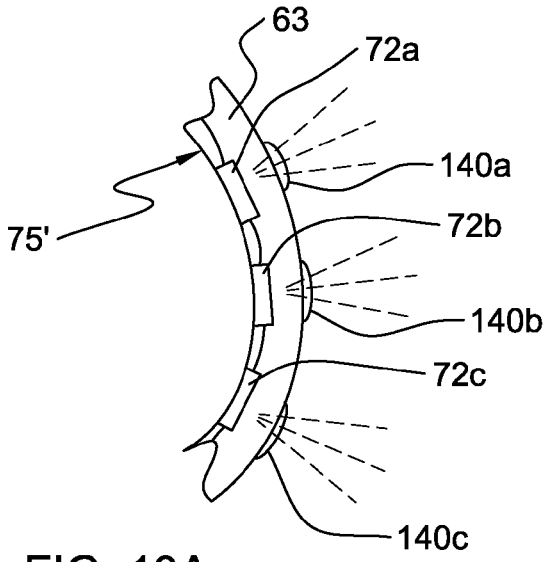
FIG. 13A illustrates a detailed view of a flex PCB having an illumination circuit configured to conform to the socket side edges of the receptacle shown in FIG. 13.

FIG. 13 illustrates a perspective view of an illuminated electrical receptacle according to a third exemplary embodiment of the present invention. As shown in FIG. 13, an assembled receptacle 600 includes illumination circuitry adapted to illuminate face edges of the receptacle, and in one embodiment, the side edges of the raised socket. FIG. 13A illustrates a detailed view of a flex PCB having an illumination circuit configured to conform to the socket side edges of the receptacle shown in FIG. 13. In one embodiment, a flex PCB 75' having the illumination circuit 100 is configured within a receptacle whether a TR or non-TR receptacle, such that the LED is adapted to illuminate face edges of the receptacle, and particularly, side edges of the raised socket structure. In this alternate embodiment, each socket structure of the cover is designed to accommodate placement of a respective LED to illuminate the exterior face cover edges. Particularly, one or more side edges 63 of a socket structure 62 may include one or more thin-walled, clear sections 140*a*, 140*b*, 140*c* (e.g., of thin clear plastic material) which may be illuminated by respective one or more light sources, e.g., LEDs within the receptacle. For example, FIG. 13A illustrates an interior of the socket defined at side edge 63 showing flex PCB 75' that conforms to the inner periphery of one or more side face edges or may flex according to the shape of the socket side edge 63 and have the illumination circuit 100 including respective LEDs 72*a*, 72*b*, 72*c* situated adjacent to or abutting each respective one or more windows (e.g., clear plastic sections) 140*a*, 140*b*, 140*c* as facilitated by flexible circuitry 75' for illuminating one or more socket and/or face edges.

Further to the embodiment of FIG. 13, it is understood that besides or in addition to clear thin walled sections 140*a*, 140*b*, 140*c*, the side face edges may incorporate a portion having a lens through which light illuminating from a light source inside the receptacle, may be directed. Thus, whether configured as a FLEX PCB or PCB assembly 75 an illuminating light emitting source (e.g., LED) is disposed within a TR or non-TR receptacle housing and adapted to illuminate the lens, which can diffuse or focus light onto and render visible one or more edges and/or face cover portions of the receptacle, i.e., illuminate surface edge and face cover. In such an embodiment, an illuminator device, e.g., a single surface mount LED from a flex or rigid PCB, may be disposed within receptacle housing and situated behind a lens, for example, such that the light from the LED is directed through the lens to the face of the device. In another embodiment, a light-pipe element may be implemented to directly communicate light emanating from a light emitting source to the lens to render visible one or more edges and/or face cover portions of the receptacle.

It should be understood that in each of the alternate embodiments depicted in FIGS. 12 and 13, the TR mechanism and platform sub-assemblies may be included or omitted.

Alternative Power Arrangement for Light Illumination Circuitry

Figure 14:
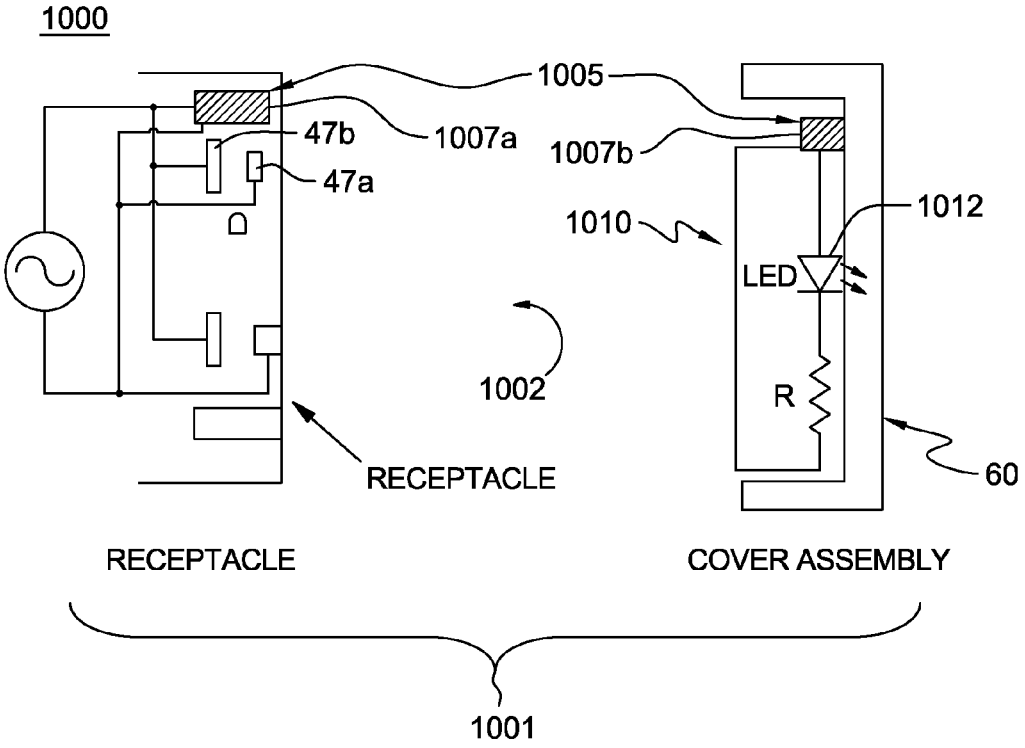
FIG. 14 illustrates a first alternate power source arrangement for an illuminating circuit.

FIG. 14 illustrates a first alternate power source arrangement for an illuminating circuit. In this alternate embodiment, the illuminating light sources provided for illuminating the receptacle, including the TR sliders, ground prong opening and face cover or socket side edges as described herein, may be powered using a power transformer such as the power transformer/transformer unit 1005 in a power supply arrangement 1000 for a receptacle 1001 as depicted in FIG. 14. In such an arrangement as shown in FIG. 14, a transformer unit 1005 particularly includes two discrete coils (inductors) 1007*a*, 1007*b* in a mutually inductive coupling arrangement, i.e., in proximity (distance), diameter and coil ratio, etc., to function as a power transformer according to the inductance caused by a magnetic field generated by electric currents through the coils according to Ampere's law, for stepping down the line voltage and current to levels suitable for powering the light illumination circuit 1010 that includes a hard-wired connection resistor (R) in series with one or more LEDs 1012. In one embodiment, the two coil arrangement 1005 is situated partially within a space 1002 provided by clearance within the receptacle housing when fully assembled. The arrangement includes hard-wire connections to the respective terminals 47*a*, 47*b*, of the receptacle to windings of primary coil 1007*a*, for example.

Thus, for example, in an alternate embodiment to the assemblies of FIGS. 6, 6A for illuminating the TR slider, the powering arrangement 1000, as depicted in FIG. 14, may be used to power a first inductive coil 1007*a* located at or near the base of the receptacle and configured for providing power to the second coil 1007*b* disposed at or near a base of the TR platform 70*a*, 70*b* in such a mutual inductive coupling arrangement, within the receptacle, i.e., in proximity (distance), diameter and coil ratio, etc., to function as a power transformer for stepping down the line voltage and current to levels suitable for powering the light illumination circuit including a resistor (R) in series with the light illuminating source, e.g., LED, for lighting the TR sliders in an alternate embodiment.

Figure 15:
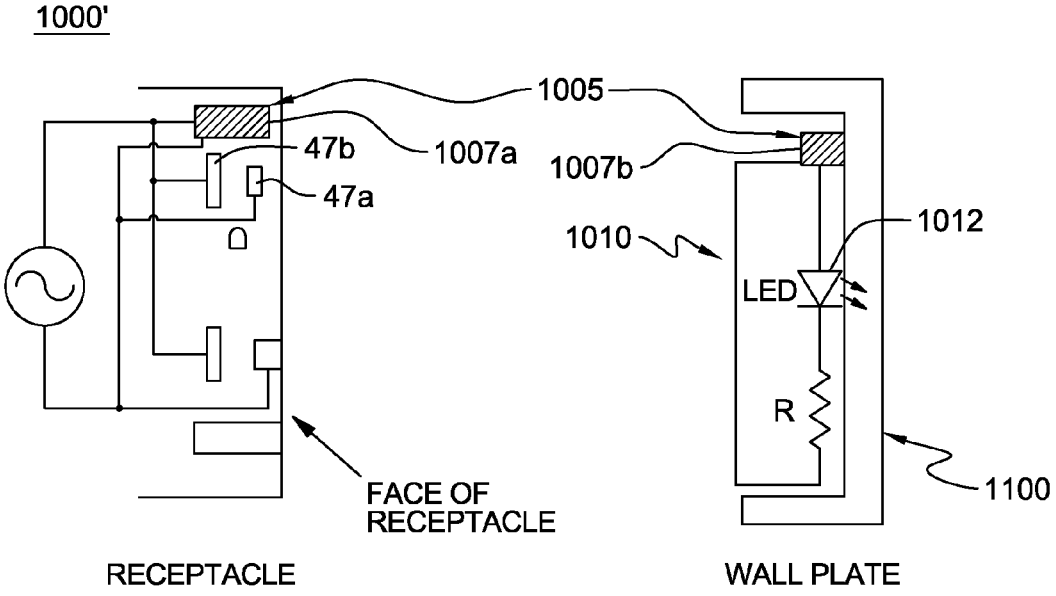
FIG. 15 illustrates a second alternate power source arrangement for an illuminating circuit.

FIG. 15 illustrates a second alternate power source arrangement for an illuminating circuit. This alternate embodiment may be an alternate power arrangement for the embodiment of the receptacle shown in FIGS. 12, 12A for illuminating an LED(s) or lens(es) at the side face edges of the socket formed in the cover assembly 60; and further, as an alternate power arrangement for the receptacle of FIGS. 13, 13A for illuminating LED(s) exclusively at a ground pin opening. The powering arrangement 1000, as depicted in FIG. 14, may be used to power a first inductive coil 1007*a*, e.g., located at or near the TR platform assemblies 70*a*, 70*b* and configured for providing power to the second coil 1007*b* disposed at or near the face of the receptacle, which for example, may be used for providing a source of illumination at or near the face of the cover or side edges of the socket assembly used for illuminating a wall plate or face plate 1100 adapted for arrangement with the cover assembly. Further to the embodiment of FIG. 15, the power arrangement 1000' includes coils 1007*a* and 1007*b* placed in a mutual inductive coupling arrangement, within the receptacle (i.e., in proximity (distance), diameter and coil ratio, etc.) to function as a power transformer for stepping down the line voltage and current to levels suitable for powering the light illumination circuit including a resistor (R) in series with the light illuminating source(s) (e.g., LEDs) for illuminating, via a lens or clear thin-walled section of the cover assembly or socket side edge, with the wall plate or face cover portion and/or ground pin opening to indicate power is being received at the receptacle. In one embodiment, a light-pipe membrane or element may be used to communicate light from an LED to a lens or thin-walled surface edge surface portion for illuminating such a lens or thin-walled surface edge surface portion in the manner as described herein.

Further, in accordance with the teachings herein, and as described in commonly-owned, co-pending U.S. patent application Ser. No. 12/725,991 the whole content and disclosure of which is incorporated by reference as if fully set forth herein, when the receptacle is mated or connected with a wall plate, the light from the LEDs may be directed through the clear sections 140 for directly lighting the wall plate largely fashioned as a light-pipe for diffusing the received light throughout the wall plate. In one embodiment, when using a wall plate adapted to fit over the cover of the receptacle, the light from the LEDs directed through the clear windows 140 are received at a side edge face of the wall plate. In this instance, the wall plate distributes the received light to illuminate the wall plate.

In a further example, as illustrated in FIG. 14, there is an alternate embodiment for providing power to solely illuminate a ground pin opening such as described in connection with the embodiment depicted in FIGS. 12, 12A. That is the powering arrangement 1000, as depicted in FIG. 14, may be used to power a first inductive coil 1007*a* located at or near the wiring module (e.g., as implemented in the Lev-Lok® design) and configured for providing power to the second coil 1007*b* disposed at or near the base of the receptacle in such a mutual inductive coupling arrangement, within the receptacle (i.e., in proximity/distance, diameter and coil ratio, etc.) to function as a power transformer for stepping down the line voltage and current to levels suitable for powering the light illumination circuit including a resistor (R) in series with the light illuminating source (e.g., LED) for exclusively illuminating a ground pin opening. In one embodiment, the illuminating LED is situated at or near a sealed chamber or compartment formed for receiving the ground blade or prong opening within the receptacle body.

Figure 16A:
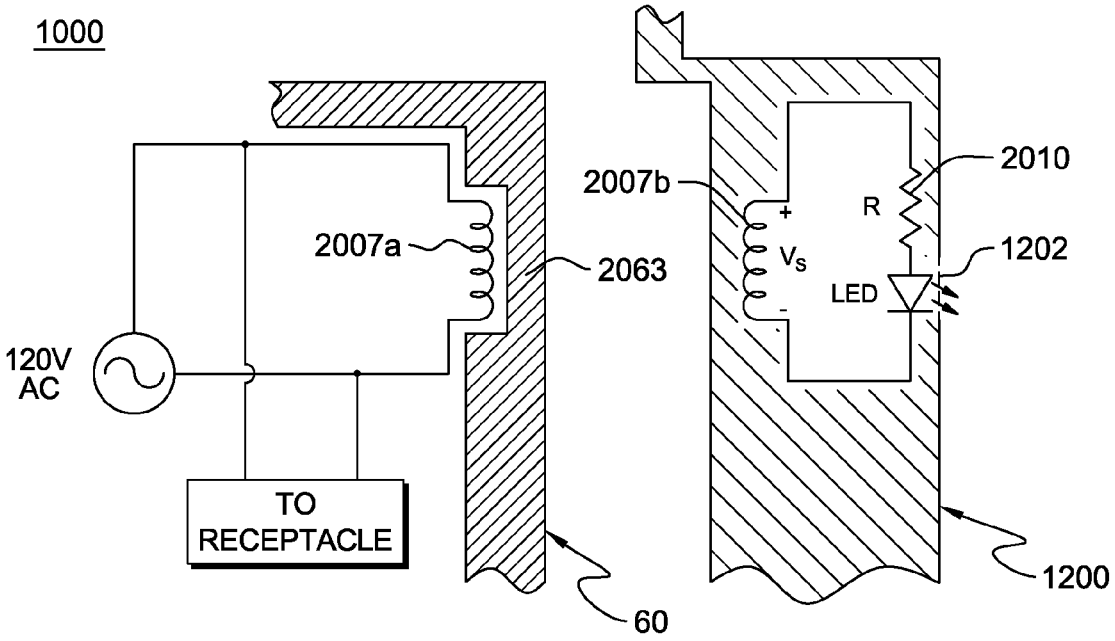
FIGS. 16A and 16B illustrate a third alternate power source arrangement for an illuminating circuit.
Figure 16B:
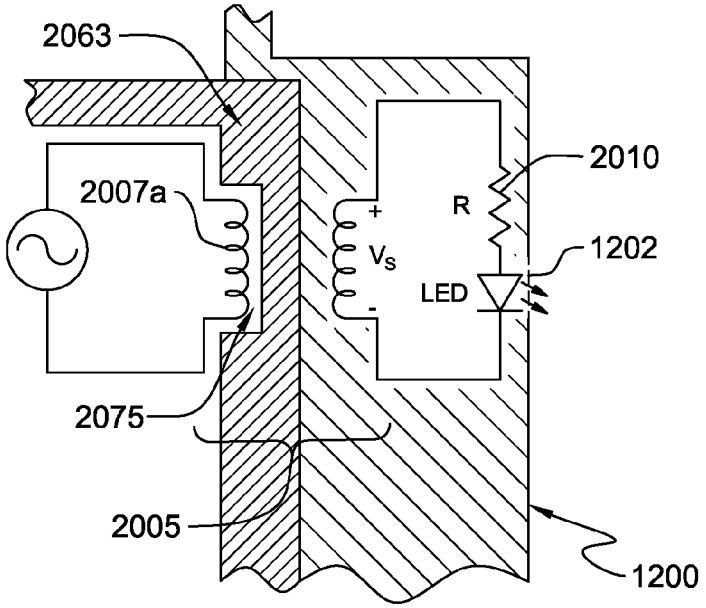

FIGS. 16A and 16B illustrate a third alternate power source arrangement for an illuminating circuit. In this alternate embodiment, electrical power may be provided directly to an illumination system embedded within a translucent or partially translucent faceplate assembly for directly illuminating the wall plate or face plate itself. More particularly, a powering arrangement 2000, as depicted in FIGS. 16A, 16B, may be used to power a light illumination system provided for directly illuminating a faceplate assembly 1200 such as shown in FIG. 16A. In such an embodiment, as shown in FIGS. 16A, 16B, the faceplate assembly 1200 may include one or more translucent or partially translucent surface areas 1202 through which light from an LED may be illuminated. Embedded within the faceplate assembly is an illumination system including a circuit embedded into the wall plate itself having its power source (a power receiving coil) 2007*a*, and a series light illumination circuit 2010 including one or more light illumination sources, e.g., LEDs and a series resistor R, for example.

Thus, in a further embodiment of illuminating a wall plate cover, the powering arrangement 2000, as depicted in FIG. 16A, may be used to power a first inductive coil 2007*a* located at or near the face of receptacle (e.g., underneath or adjacent with a socket or cover receptacle cover 60 or side edges thereof), and configured for providing power to the second coil 2007*b* disposed within the wall plate assembly 1200 in a mutual inductive coupling arrangement as shown in FIG. 16B (i.e., in proximity (distance) 2005, diameter and coil ratio, etc.) to function as a power transformer for stepping down the line voltage and current to levels suitable for powering the light illumination circuit 2010 to illuminate the whole wall plate or face plate or specific portions thereof of the wall plate.

As shown in FIG. 16B, in an exemplary embodiment, conductive terminals providing A.C. (alternating current) power to an electrical device within a receptacle housing are adapted for further providing, by conductive leads, power to the first coil 2007*a* at or near a cover portion, e.g., a cover assembly, socket, or receptacle face, or side-edges 2063 thereof, that is overlayed with or mated in abutting arrangement to the faceplate assembly 1200. In one embodiment, the single coil is located proximate the face plate or side edge 2063 such that when mated in abutting arrangement, the first coil 2007*a* and second coil 2007*b* of the wall plate assembly align for mutual inductance coupling. As shown in greater detail in FIG. 16B, a portion 2075 of the cover assembly, socket, receptacle face, or side-edge, may be thinned to accommodate placement of the first coil 2007*a* and/or further to ensure that the distance 2005 between the first coil 2007*a* and the aligned second coil 2007*b* when assembled with the face or wall plate assembly, is sufficient to achieve mutual inductance coupling for providing power to the illumination circuit situated in adjacent alignment with the edge 2063, overlayed next to the receptacle.

Table 1 provides a summary of the different surface mutual inductive coupling arrangements for powering the lighting source elements by means of inductive coupling:

TABLE 1

| Power to first inductive coil | Power from second inductive coil to lighting element |
|---|---|
| Face of receptacle | Wall plate |
| TR platform | Face of receptacle |
| Base of receptacle | TR platform |
| Wiring module (Lev-Lok ®) | Base of receptacle |
| Existing electrical wiring | Wiring module (Lev-Lok ®) |

It is understood that the powering arrangement 1000' as depicted in FIG. 15, and the powering arrangement 2000 as depicted in FIGS. 16A, 16B, may be used to provide power to any lighting system for illuminating a faceplate for any electrical device/receptacle, including, but not limited to, switches, dimmers, sensors, lighting controls, and combinations thereof, of single gang and multi-gang varieties including the power outlet such as described herein.

Further, all of the embodiments described herein are applicable to electrical devices including 240 Volts power outlets, outlets that include GFCI circuits, surge suppressors, etc.

Further, it should be understood that, in each of the embodiments described herein, there is provided electrical coupling between existing power lines and internal conductive terminals, e.g., via conductive structures as provided in the Lev-Lok® device, or alternatively, via hard-wiring of the electrical power lines to the hot and neutral as generally known in the art (e.g. screw terminals).

Although a few examples of the present invention have been shown and described, those skilled in the art would appreciate that changes might be made in these embodiments without departing from the principles and spirit of the invention, the scope of which is defined in the claims and their equivalents.

What is claimed is:

1. An illuminated receptacle comprising:

a housing configured to be received within an electrical box, said housing including electrically conductive terminals for receiving electrical power and one or more sockets for receiving a plug to receive electrical power from said electrical box, each socket having at least two openings aligned with said electrically conductive terminals for receiving a respective prong of said plug;

a tamper resistant (TR) platform associated with each of the one or more sockets, each of the TR platforms being disposed between the housing, each of the TR platforms including a cavity and an aperture extending thru said platform in said cavity;

a slider disposed within each of the cavities of the platform and aligned with said at least two openings of a respective socket, said slider adapted to one of: prevent or permit insertion of said prongs within said at least two openings of a respective said one or more sockets; and, a light source disposed within each of the apertures formed in the platforms, the light sources operatively coupled to said electrical power for generating light to illuminate said slider, the light sources being positioned to directly transmit light to the sliders.

2. The illuminated receptacle as in claim 1, wherein said housing includes a body and a cover for coupling to said body, said body including the electrically conductive terminals for receiving electrical power, the cover including the one or more sockets for receiving a plug to receive electrical power from said electrical box.

3. The illuminated receptacle as in claim 2, wherein said housing includes a first socket structure and a second socket structure, said platform comprising first and second cavities adapted to fit within respective said first socket and second socket structures, said first and second TR platforms connected by an intermediate connector member, wherein said first and second TR platforms and intermediate connector member are of unitary construction.

4. The illuminated receptacle of claim 1, wherein the apertures formed in the platform and the light source disposed with each aperture are configured such that emitted light is concentrated in a form of a cone to directly illuminate said slider.

5. The illuminated receptacle as in claim 4, further comprising:

an electrical circuit disposed within said housing for interconnecting said light sources, said circuit comprising a series connection including the light sources and a resistive element connected between an electrical power source and an electrical ground or neutral.

6. The illuminated receptacle as in claim 5, wherein said electrical circuit is located on a printed circuit board (PCB) disposed within said housing, wherein said electrical circuit includes conductive leads for extending each said at least one light source beyond an edge of said PCB for alignment with said apertures.

7. The illuminated receptacle as in claim 6, wherein said printed circuit board (PCB) is a flexible printed circuit.

8. The illumination system as claimed in claim 5, wherein each said at least one light source comprises a light emitting diode.

9. The illuminated receptacle as in claim 5, wherein said electrical box is adapted for mounting in a wall and configured to connect said electrical conductive terminals to one of an electrical power source line and to a ground or neutral power return line, said receptacle further comprising:

first conductive structure within said housing for connecting a first said electrical conductive terminal receiving electrical power to a first terminal of said electrical circuit; and, second conductive structure within said housing for connecting a second said electrical conductive terminal receiving said neutral power return line to a second terminal of said electrical circuit.

10. The illuminated receptacle as in claim 6, wherein said housing includes a first socket structure and a second socket structure, said platform comprising first and second cavities adapted to fit within respective said first socket and second socket structures, said first and second TR platforms connected by an intermediate connector member, wherein said first and second TR platforms and intermediate connector member are of unitary construction.

11. The illuminated receptacle as in claim 10, wherein said printed circuit board is press-fit mountable on top of or underside said intermediate connector member.

12. The illuminated receptacle as in claim 10, wherein said tamper resistant (TR) platform includes a base having said aperture, said platform base defining a first axis, wherein said conductive leads extends said at least one light source substantially orthogonal to said first axis for disposition within said aperture.

13. The illuminated receptacle as in claim 6, wherein said first and second terminals of said electrical circuit including conductive members located on said PCB for contacting respective first conductive and second conductive structures for providing power to said electrical circuit.

14. The illuminated receptacle as in claim 1, wherein said sliders are manufactured from a partially translucent or transparent material.

15. The illuminated receptacle as in claim 14, wherein said electrical power source comprises: a first coil adapted for receiving power from said electrically conductive terminals, and said illumination circuit comprises: a second coil in said series connection, said second coil situated at or near said first coil within said housing for receiving power from said first coil by inductive coupling to power said electrical circuit for lighting said light sources.

16. An illuminated receptacle comprising:

a body including electrically conductive terminals for receiving electrical power;

a cover for coupling to said body, said cover having first and second sockets for receiving first and second plugs, respectively, to transmit electrical power from said electrical box, each socket having at least two openings aligned with said electrically conductive terminals for receiving a respective prong of said plug;

first and second tamper resistant (TR) platforms associated with the first and second sockets, respectively, each of the TR platforms being disposed within the cover, the first and second platforms each including a cavity and an aperture extending thru said platform in said cavity;

first and second sliders disposed within the cavities of the first and second platforms, respectively, the first and second sliders being aligned with the openings of the first and second sockets, respectively, the sliders being adapted to one of: prevent or permit insertion of said prongs within said openings of a respective socket; and, first and second light sources disposed within the apertures formed in the first and second platforms, respectively, the light sources operatively coupled to said electrical power for generating light to illuminate said first and second sliders, respectively, the light sources being positioned to directly transmit light to the sliders.

17. The illuminated receptacle as in claim 16, said first and second TR platforms are connected by an intermediate connector member, wherein said first and second TR platforms and intermediate connector member are of unitary construction.

18. The illuminated receptacle of claim 17, wherein the apertures formed in the platform and the light source disposed with each aperture are configured such that emitted light is concentrated in a form of a cone to directly illuminate said slider.

19. The illuminated receptacle as in claim 18, wherein said sliders are manufactured from a partially translucent or transparent material.

20. The illuminated receptacle as in claim 19, further comprising:

an electrical circuit disposed within said body for interconnecting said light sources, said circuit comprising a series connection including the light sources and a resistive element connected between an electrical power source and an electrical ground or neutral.

21. The illuminated receptacle as in claim 20, wherein said electrical circuit is located on a printed circuit board (PCB) disposed within said body, wherein said electrical circuit includes conductive leads for extending each said at least one light source beyond an edge of said PCB for alignment with said apertures.

22. The illuminated receptacle as in claim 21, wherein said printed circuit board is press-fit mountable on top of or underside said intermediate connector member.

23. The illuminated receptacle as in claim 21, wherein said printed circuit board (PCB) is a flexible printed circuit.

24. The illuminated receptacle as in claim 23, wherein said first and second terminals of said electrical circuit including conductive members located on said PCB for contacting respective first conductive and second conductive structures for providing power to said electrical circuit.

25. The illuminated receptacle as in claim 21, wherein said tamper resistant (TR) platform includes a base having said aperture, said platform base defining a first axis, wherein said conductive leads extends said at least one light source substantially orthogonal to said first axis for disposition within said aperture.

26. The illuminated receptacle as in claim 20, wherein said electrical power source comprises: a first coil adapted for receiving power from said electrically conductive terminals, and said illumination circuit comprises: a second coil in said series connection, said second coil situated at or near said first coil within said body for receiving power from said first coil by inductive coupling to power said electrical circuit for lighting said light sources.

27. The illumination system as in claim 20, wherein each said at least one light source comprises a light emitting diode.

28. The illuminated receptacle as in claim 20, wherein said electrical box is adapted for mounting in a wall and configured to connect said electrical conductive terminals to one of an electrical power source line and to a ground or neutral power return line, said receptacle further comprising:

first conductive structure within said housing for connecting a first said electrical conductive terminal receiving electrical power to a first terminal of said electrical circuit; and, second conductive structure within said housing for connecting a second said electrical conductive terminal receiving said ground or neutral power return line to a second terminal of said electrical circuit.

* * * * *